US009233743B2

(12) United States Patent
Daikoku et al.

(10) Patent No.: US 9,233,743 B2
(45) Date of Patent: Jan. 12, 2016

(54) STEERING DEVICE OF OUTBOARD MOTOR

(75) Inventors: Keisuke Daikoku, Shizuoka (JP); Tetsushi Achiwa, Shizuoka (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 345 days.

(21) Appl. No.: 13/465,295

(22) Filed: May 7, 2012

(65) Prior Publication Data

US 2012/0286129 A1 Nov. 15, 2012

(30) Foreign Application Priority Data

May 13, 2011 (JP) ..... 2011-108250

(51) Int. Cl.

| | |
|---|---|
| ***B63H 20/22*** | (2006.01) |
| ***B63H 20/32*** | (2006.01) |
| ***B63H 21/20*** | (2006.01) |
| *B63H 25/30* | (2006.01) |
| *B63H 20/06* | (2006.01) |

(52) U.S. Cl.

CPC ..... *B63H 20/22* (2013.01); *B63H 20/32* (2013.01); *B63H 21/20* (2013.01); *B63H 20/06* (2013.01); *B63H 25/30* (2013.01)

(58) Field of Classification Search

CPC ..... B63H 21/21; B63H 20/12; B63H 20/32; B63H 21/20; B63H 20/08; G05D 1/00

USPC ..... 248/642; 440/1, 53

See application file for complete search history.

(56) References Cited

U.S. PATENT DOCUMENTS

| | | | | |
|---|---|---|---|---|
| 2,507,844 | A * | 5/1950 | Wright | 440/63 |
| 2,981,222 | A * | 4/1961 | Cunefare | 440/62 |
| 3,486,724 | A * | 12/1969 | Adamski | 248/567 |
| 4,406,634 | A * | 9/1983 | Blanchard | 440/61 R |
| 4,516,940 | A * | 5/1985 | Roberts | 440/53 |
| 4,666,410 | A * | 5/1987 | Anselm | 440/61 R |
| 5,201,238 | A | 4/1993 | Hayasaka | |
| 5,224,888 | A | 7/1993 | Fujimoto et al. | |
| 5,503,576 | A * | 4/1996 | Ming et al. | 440/52 |
| 6,609,939 | B1 * | 8/2003 | Towner et al. | 440/111 |
| 6,682,374 | B2 | 1/2004 | Kokubo | |
| 2002/0193021 | A1 | 12/2002 | Kokubo | |

FOREIGN PATENT DOCUMENTS

| | | | |
|---|---|---|---|
| EP | 1316499 | B1 | 5/2008 |
| JP | 3038606 | B2 | 5/2000 |
| JP | 3046398 | B2 | 5/2000 |
| JP | 2003-2294 | A | 1/2003 |
| JP | 2003-205892 | A | 7/2003 |
| JP | 2007-230510 | A | 9/2007 |

* cited by examiner

*Primary Examiner* — Lars A Olson
(74) *Attorney, Agent, or Firm* — Troutman Sanders LLP

(57) ABSTRACT

An engine is housed in an engine case and a propulsion unit driven by the engine is provided outside the engine case. By a swivel bracket installed in a predetermined part of the engine case, the propulsion unit is pivotally supported around a steering shaft, and centers of a drive shaft driving the propulsion unit and of the steering shaft are matched.

4 Claims, 22 Drawing Sheets

STEERING DEVICE OF OUTBOARD MOTOR

CROSS-REFERENCE TO RELATED APPLICATIONS

This application is based upon and claims the benefit of priority of the prior Japanese Patent Application No. 2011-108250, filed on May 13, 2011, the entire contents of which are incorporated herein by reference.

BACKGROUND OF THE INVENTION

1. Field of the Invention

The present invention relates particularly to a steering device in an outboard motor.

2. Description of the Related Art

As a mainstream propulsion engine or a propulsion system of a craft or a boat, there are outboard motor, an inboard-outdrive motor, an inboard motor, and so on. The outboard motor among these is called an outboard drive or the like, and is integrally constituted with an engine, an auxiliary machine or the like thereof, a gear or a shaft of a driving system, a screw, and so on, and in general, is mounted on a transom board at a stern of a hull. The outboard system is typically mounted on a small-sized boat or the like, and has a steering function and a tilting function.

Further, the inboard-outdrive motor is called an inboard engine outboard drive or the like, as an installation method of a propulsion engine of a small-sized craft or the like, and an engine is mounted on an inboard stern portion and a drive unit made by integrating a reduction gear, a forward/backward clutch, a propeller, and so on is disposed in the exterior.

When such a boat actually travels on sea or on water, steerage is quite important, and various measures are taken in a steering device for steering. For example, a conventional outboard motor is fixed to a hull with a pair of clamp bracket portions, and a swivel bracket is supported between the clamp brackets via a through tube (tilt shaft). An outboard motor main body steers centering on a steering shaft on the swivel bracket. At a time of steering, a lift force (steering force) occurs in a lateral direction, and this force is transmitted to the hull via the clamp bracket.

Further, in a conventional small-sized outboard motor, a driving shaft and a steering shaft are matched. Therefore, a large steering angle can be set as a steering angle and is able to be steered, and in some cases steering of 360 degree is possible.

Further, in a conventional inboard-outdrive motor, a tilt shaft and a steering shaft are placed in a center of a universal joint of a drive shaft.

Further, a conventional method called sea drive is known and can achieve a large steering angle by mounting an outboard motor of large output on a swivel bracket in a manner to match a steering shaft and a drive shaft.

Further, a conventional form called POD is know, in which a drive shaft and a steering shaft match, and thus a large steering angle can be achieved, usually enabling a steering angle of about 360 degrees.

However, in the conventional outboard motor, the clamp brackets are fixed to the hull in a cantilever manner. Thus, at a time of trim movement (tilt), since a lift force (steering force) center comes away from the hull to the rear, the clamp brackets becomes open in a shape of separated "V". There has been a problem that an outboard motor cannot generate a large lift force (steering force) for the above reason. Further, there has been a problem that a trim (tilt) angle cannot be made large in a state of thrust. Further, there has been a problem that steering does not work well for a similar reason, leading to a poor performance of turning in a small radius.

Further, in the conventional small-sized outboard motor, an engine is mounted on a steering shaft receiving portion, and more concretely, a mount gum thereof is in an outer side of the steering shaft receiving portion. Thus, there has been a problem that engine vibration is easy to be transmitted to a hull. Further, since a span of a steering shaft receiver is short, the outboard motor can withstand a small propulsion force but cannot be applied to a large propulsion force as in a case of a large-sized outboard motor or the like.

Further, in the conventional inboard-outdrive motor, since a bending angle of the universal joint is limited, a tilt angle and a steering angle are smaller than those of an outboard motor. Therefore, there has been a problem that steering does not work well, leading to a poor performance on turning in a small radius.

Further, in the conventional method called sea drive, since an outboard motor engine part is positioned low in relation to a water surface, there is a problem that the engine is easy to be wetted, making it hard to keep reliability and corrosive resistance. Further, since the tilt shaft is positioned apart from a gravity center of the outboard motor, a large tilt device is necessary or an inertial mass is large, and thus there has been a problem that a large impact force occurs at a time of collision with a driftwood or the like.

Further, the above-noted conventional method is exclusive to a large-sized craft for which shallows are not taken into consideration, and there has been a problem that if the method is to be applied to a boat, the boat is largely damaged at a time of collision against an obstacle (including a seafloor) since there is no impact absorbing mechanism.

Further, in an outboard motor or the like of this kind, since a drive shaft and a steering shaft are matched, a large steering angle can be obtained, but because of the fact that a lift force (steering force) is supported by a gimbal surface (a mounting surface to a transom board) apart from the steering shaft, a large steering force cannot be given, resulting in a problem that high-speed turning in a small radius is not possible.

Further, since the steering shaft and the drive shaft match, the large steering angle can be given, but since the steering shaft (drive shaft) is not orthogonal to a traveling direction of a boat, a lateral direction component of the steering force is small and high-speed turning is not possible.

Further, since the engine is disposed at a high position and thus is advantageous in view of being wet, and in some cases mounting thereof on the hull is as simple as mounting of an outboard motor, but since the drive shaft is universally joined, there is a problem that neither a steering angle nor a tilting angle can be taken large.

SUMMARY OF THE INVENTION

In view of the above circumstances, an object of the present invention is to provide a steering device of an outboard motor which steering device is superior in steerage and operability and effectively realizes downsizing.

A steering device of an outboard motor of the Present invention includes, in the outboard motor housing an engine in an engine case and having a propulsion unit driven by the engine outside the engine case, a swivel bracket installed in a predetermined part of the engine case, the swivel bracket pivotably supporting the propulsion unit around the steering shaft, wherein centers of a drive shaft driving the propulsion unit and of the steering shaft are matched.

Further, in the steering device of the outboard motor of the present invention, the drive shaft is supported in a freely rotatable manner in a swivel vertical direction in the swivel bracket, and a drive shaft housing to house the drive shaft is rotatably supported by the swivel, bracket and with a lower end of the drive shaft housing the propulsion unit is integrally connected.

Further, the steering device of the outboard motor of the present invention includes an actuator for steering driving near an upper portion of the swivel bracket, wherein a connection extended portion with the propulsion unit is formed by extending a lower portion of the drive shaft housing, thereby to pivotally bias the connection extended portion by an action of the actuator.

In the steering device of the outboard motor of the present invention, practically only the propulsion unit and the drive shaft housing are included as movable members around the steering shaft.

DETAILED DESCRIPTION OF THE PREFERRED EMBODIMENTS

Hereinafter, a preferred embodiment of a steering device of an outboard motor in the present invention will be described based on the drawings.

Figure 1:
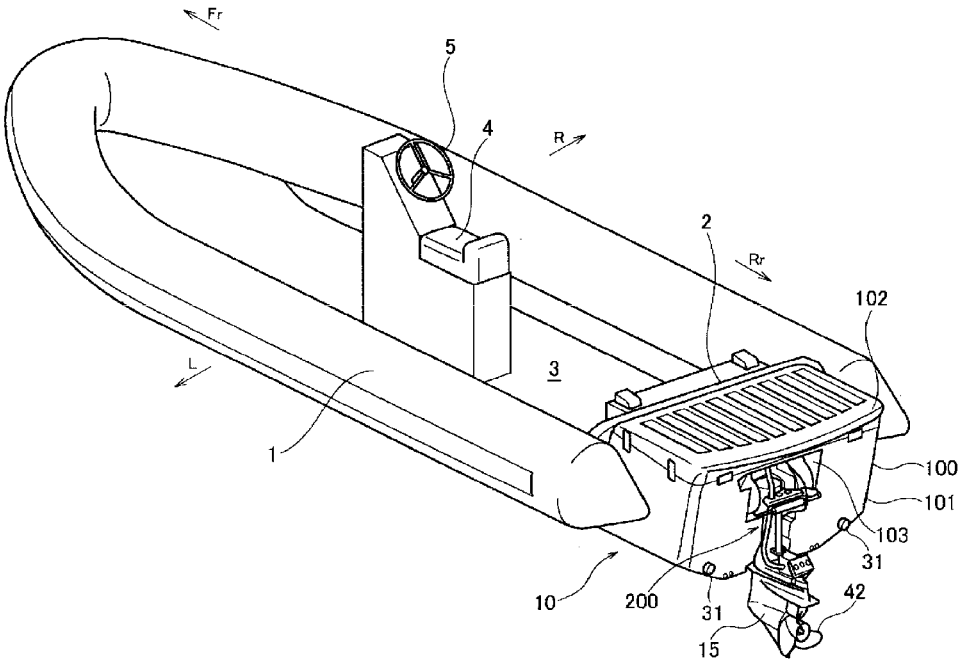
FIG. 1 is a perspective view depicting an example of a craft or a boat on which an outboard motor according to the present invention is mounted.

FIG. 1 depicts an example of a craft or a boat on which an outboard motor 10 according to the present invention is mounted. In this example, the craft is typically medium/small-sized and has a transom board 2 (stern board) at a rear portion of a hull 1. The outboard motor 10 is mounted by using the transom board 2 as depicted in the drawing. It should be noted that in an important position in each drawing referred hereunder, the front (bow side) is indicated by an arrow Fr and the rear (stern side) is indicated by an arrow Rr, respectively. Further, left and right directions (beam direction) of the hull are indicated as necessary by an arrow L and an arrow R, respectively.

Here, first, in the hull 1 according to the present embodiment, a plank 3 is laid on a bottom portion of the hull 1 as in FIG. 1, and the transom board 2 is disposed at a rear end of the plank 3. A cockpit 4 is provided near a center of the plank 3, and the cockpit 4 is provided with a device and equipment or the like necessary for driving, such as a handle, and a meter or the like. The outboard motor 10 is equipped with a motive power, a propulsion unit, a steering device, a tilt device, and so on integrally, being constituted as what is called an all-in-one type, and can be driven if usual equipment such as a fuel tank, a battery and the like are provided in a hull 1 side.

It should be noted that the boat is not limited to that of the depicted example, and there is a boat having a bracket or the like for mounting an outboard motor in a rear side of a transom board, that is, the outboard motor 10 of the present invention is effectively applicable to a boat of a type having a stern board or a part or a member equivalent to the stern board at a stern of a hull.

Figure 2:
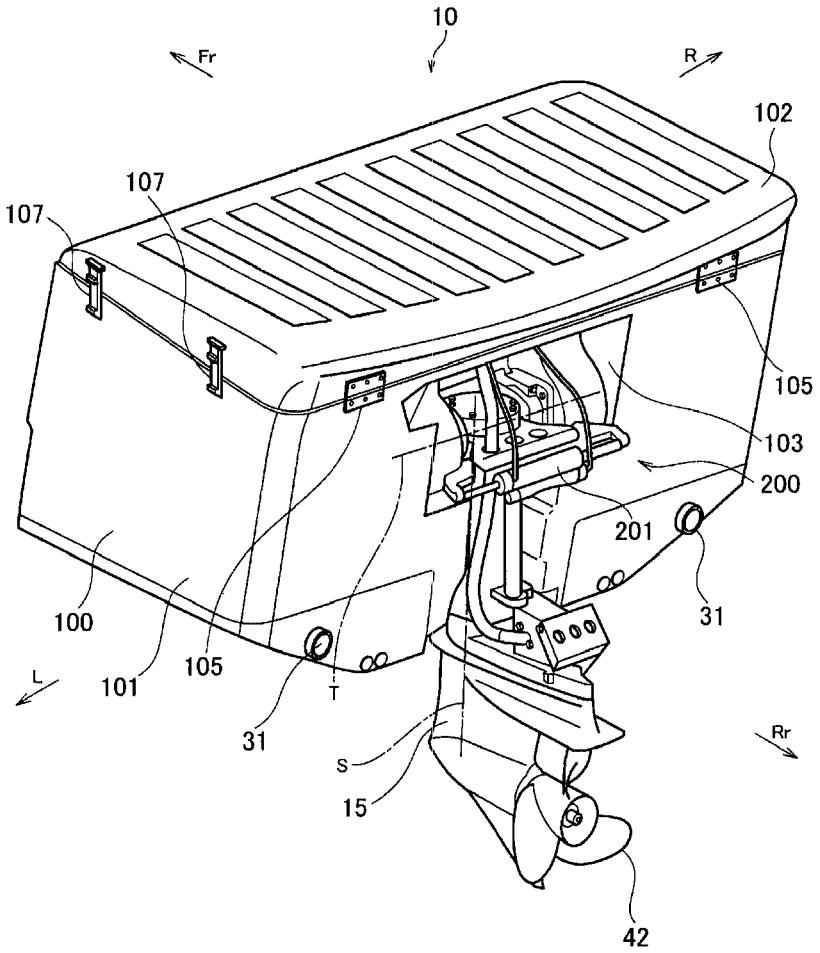
FIG. 2 is a perspective view depicting an external appearance of the outboard motor of the present invention.
Figure 3:
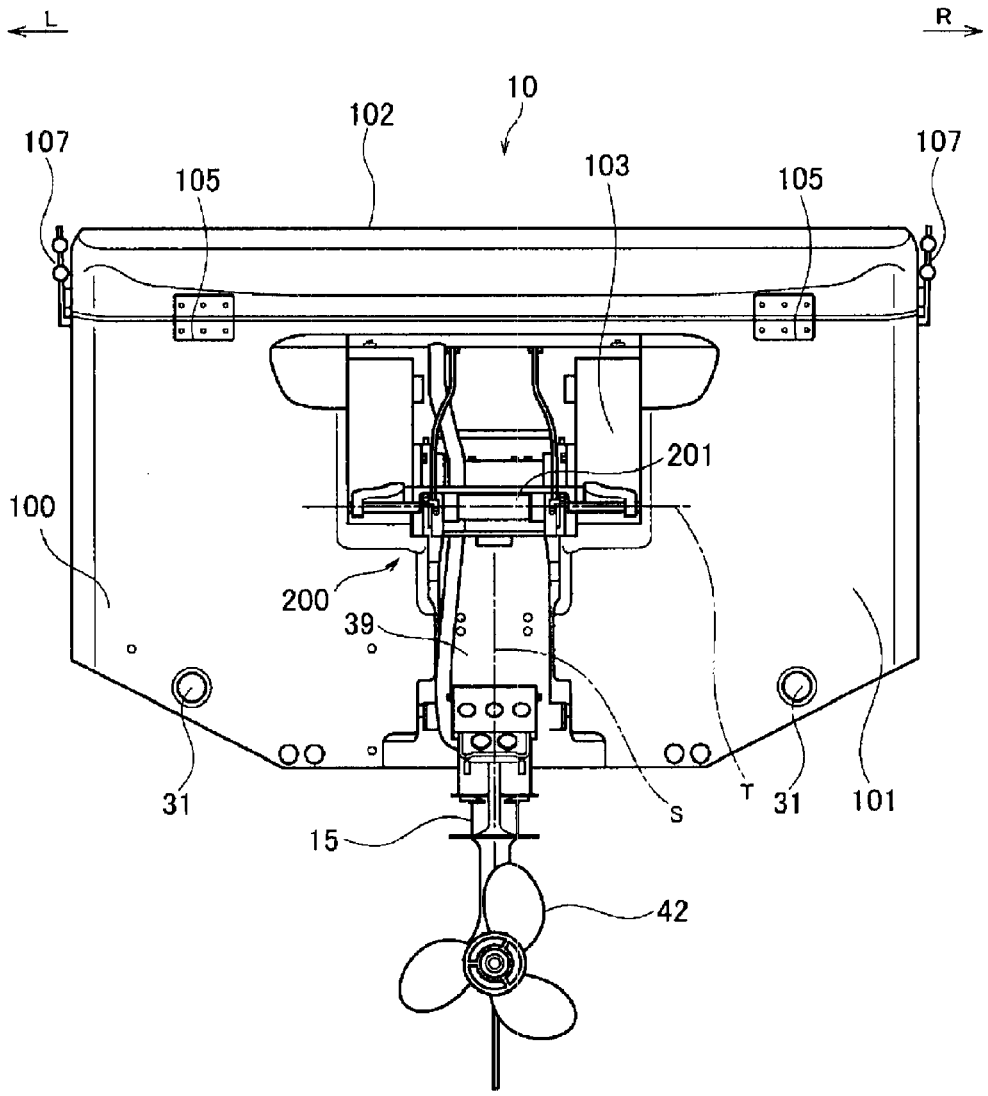
FIG. 3 is a rear view depicting the external appearance of the outboard motor of the present invention.
Figure 4:
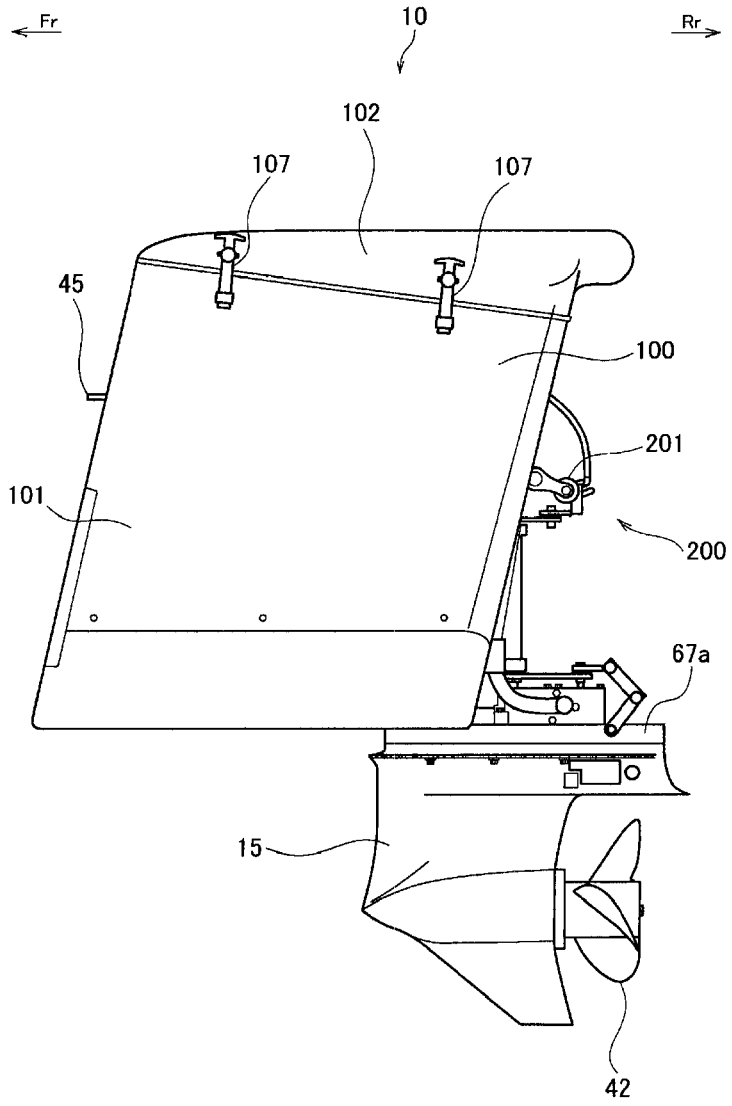
FIG. 4 is a side view depicting the external appearance of the outboard motor of the present invention.
Figure 5:
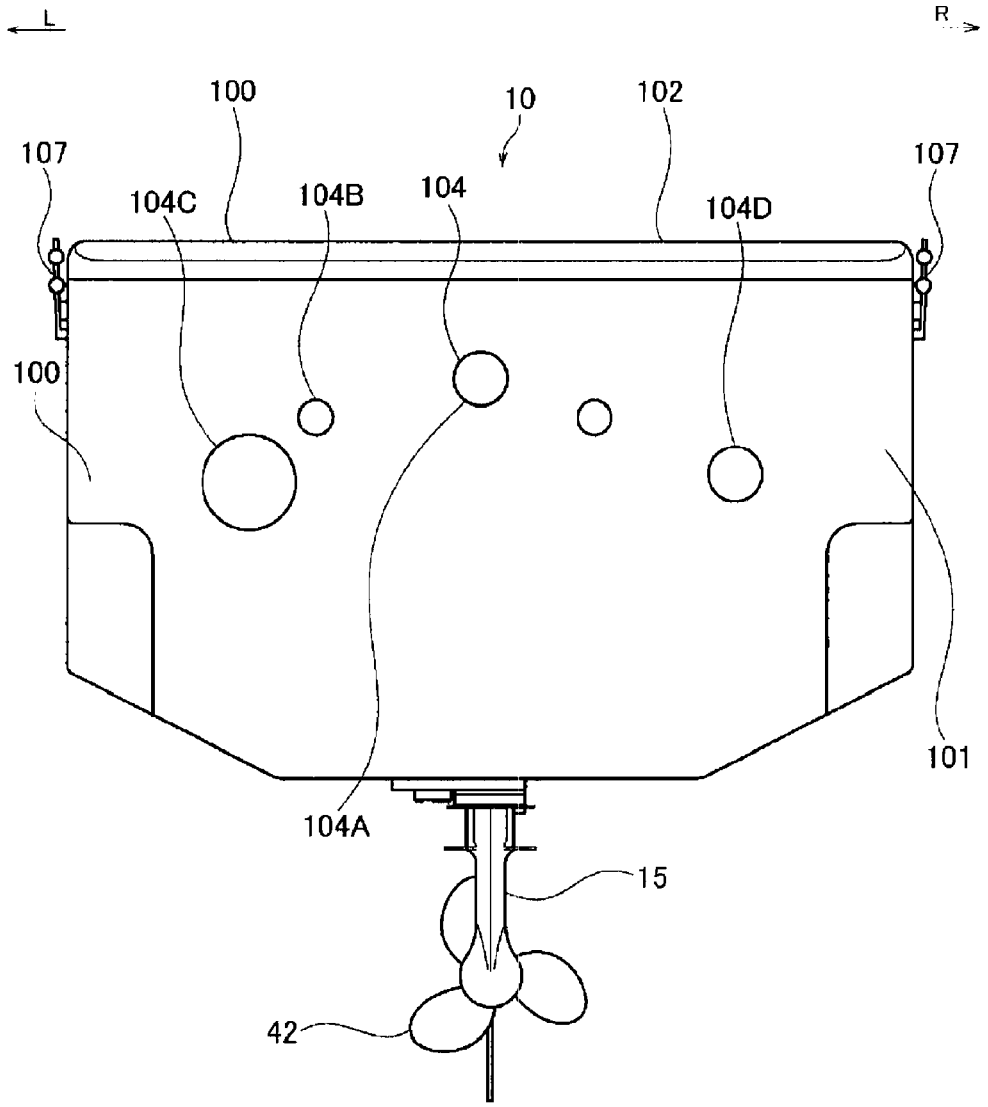
FIG. 5 is a front view depicting the external appearance of the outboard motor of the present invention.

FIG. 2 to FIG. 5 depict external appearances, FIG. 2 being a perspective view, FIG. 3 being a rear view, FIG. 4 being a side view, and FIG. 5 being a front view, of the outboard motor 10. The outboard motor 10 has an engine case 100 made of resin and houses an engine unit being a power source which will be described later inside the engine case 100, and a screw (propeller) being disposed at the rear below of the engine case 100, the screw is rotationally driven by the engine unit. The engine case 100 also functions as an exterior member constituting the external appearance of the outboard motor 10 and has an external appearance having a sense of unity as a whole.

The engine case 100 is constituted as a casing having almost the same width as that of a stern portion (typically, transom board 2) of the hull 1 also with reference to FIG. 1. In this example, a basic figure of the engine case 100 is an almost rectangular parallelepiped, and a longitudinal direction of the rectangular parallelepiped is a beam direction. The engine case 100 has a case main body 101 housing the engine unit and its peripheral component or member, and a case cover 102 covering an upper opening 101*a* (see FIG. 12) of the case main body 101.

Figure 6:
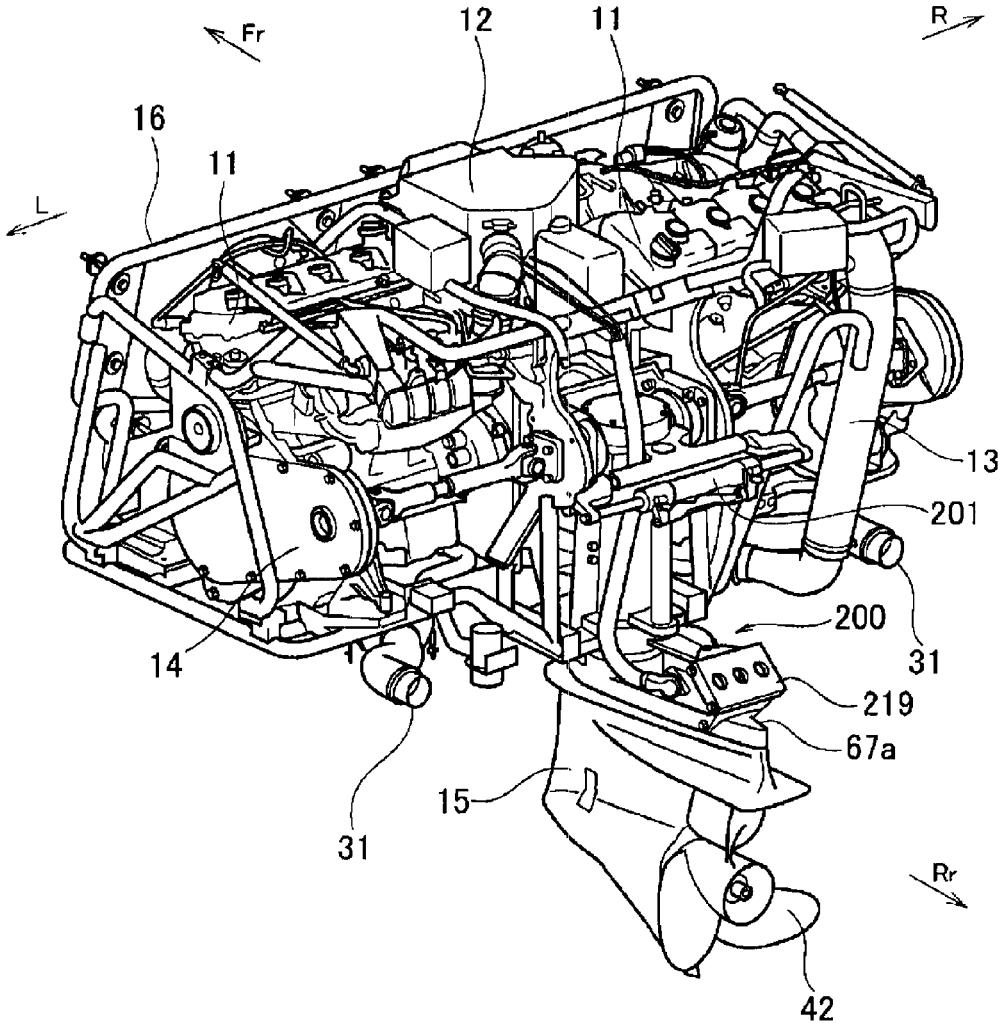
FIG. 6 is a perspective view depicting a constitution example of the inside of an engine case in the outboard motor of the present invention.
Figure 7:
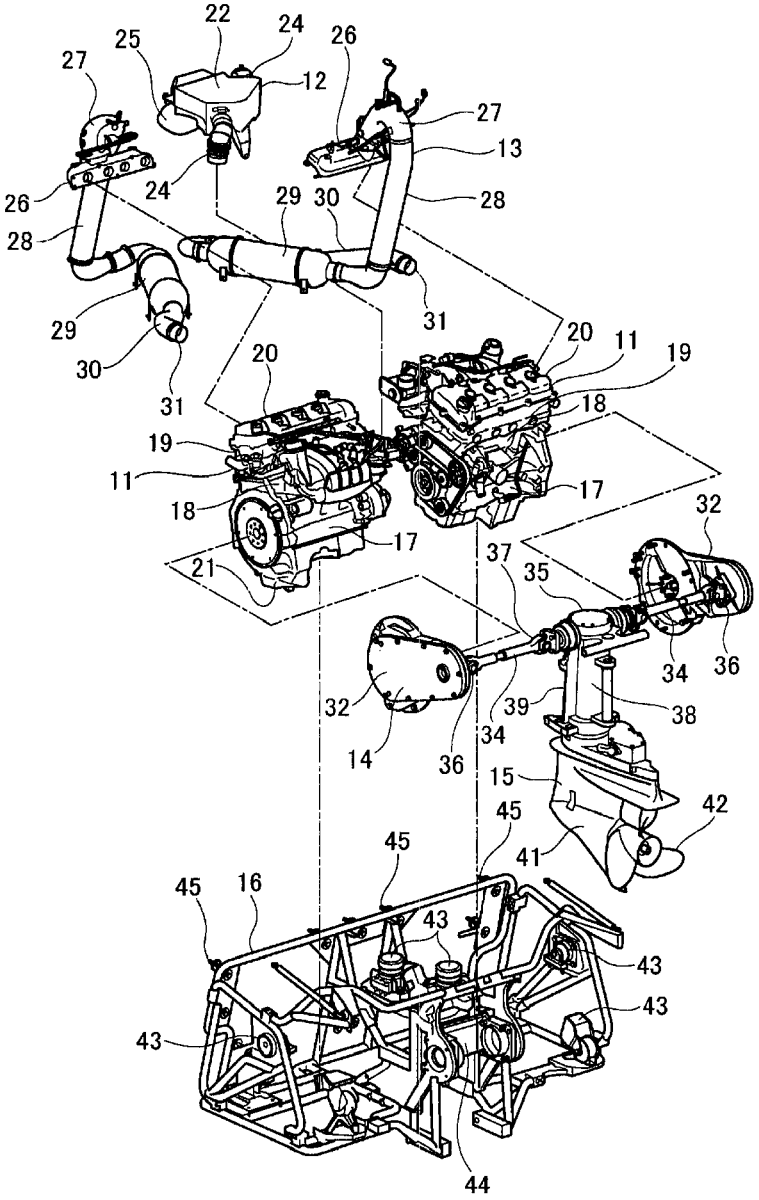
FIG. 7 is an exploded perspective view of a main constitution of the inside of the engine case in the outboard motor of the present invention.

The engine unit and its peripheral component and so on housed in the engine case 100 will be described. The outboard motor 10 of the present invention has an internal combustion engine as its power unit for main power and drives the propulsion unit by operating the internal combustion engine. FIG. 6 depicts a constitution example of the inside of the engine case 100 in the outboard motor 10, while FIG. 7 is an exploded perspective view of a main constitution of the inside of the engine case 100. In the engine case 100, an engine unit 11 constituting the power unit is disposed and housed compactly and well balanced in terms of weight. In this embodiment, two engine units 11 are included, and in the right and left of the engine case 100 a longitudinal direction of whose casing is a beam direction, a pair of engine units 11 are disposed symmetrically from the center. An intake system 12 and an exhaust system 13 are connected to the respective engine units 11 and a power transmission mechanism 14 is linked to each output end (crankshaft). The power transmission mechanism 14 is coupled to a propulsion unit 15 at a center portion in the right and left direction in a rear side of the engine unit 11, and such outboard motor constituting members are mounted and supported on a frame 16 as in FIG. 7.

Figure 8:
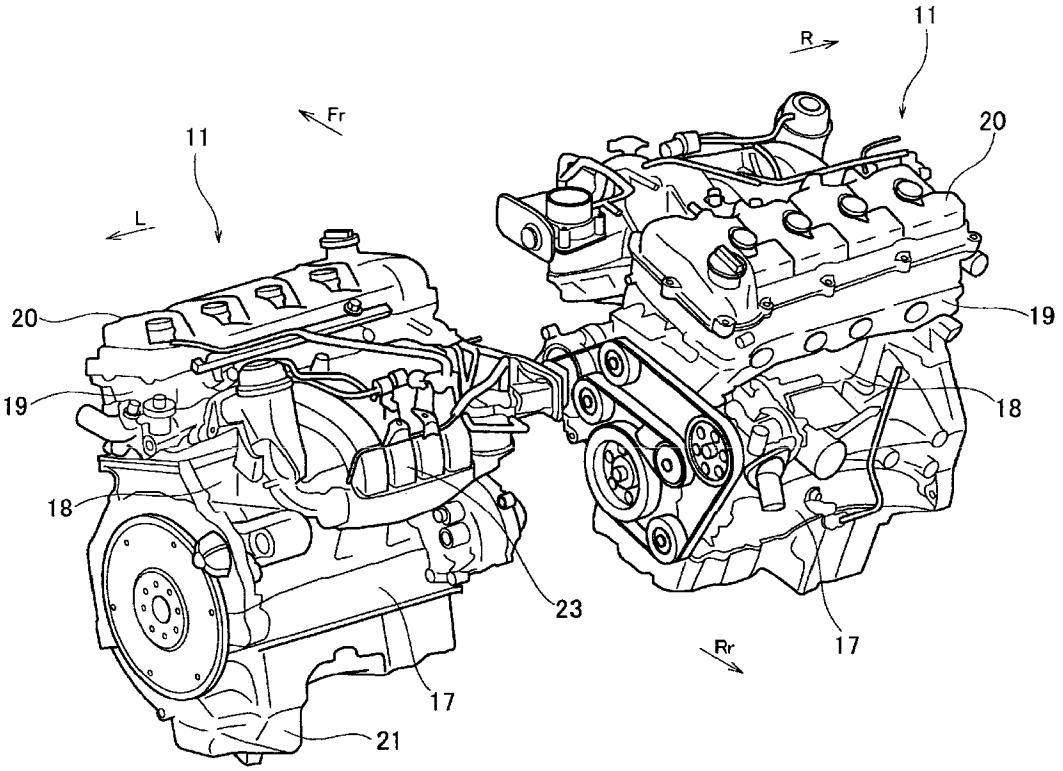
FIG. 8 is a perspective view depicting a constitution and disposition example of an engine unit of the outboard motor of the present invention.

More concretely, in the engine unit 11, a water-cooled in-line 4-cylinder 4-cycle gasoline engine is used in this example. It should he noted that the number of engine cylinders or the like can be changed appropriately as necessary, and is non limited to this example. With reference to FIG. 8, in the engine unit 11, a crank case 17, a cylinder block 13, a cylinder head 19, and a cylinder head cover 20 are integrally connected in a manner to overlap in sequence, and a sump 21 is attached to a lowest portion thereof. A crankshaft of each engine unit 11 is disposed along the beam direction (right and left direction), engine output shafts to be connected with shaft ends thereof are disposed to be positioned in right and left outer sides, that is, the engine output shaft of the right-side engine unit 11 is disposed in a right side and the engine output shaft of the left-side engine unit 11 is disposed in a left side.

Figure 9:
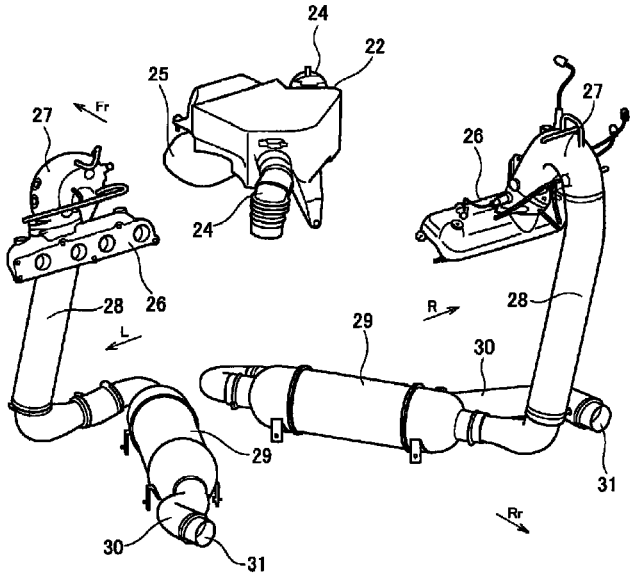
FIG. 9 is a perspective view depicting a constitution and disposition example of an intake/exhaust system of the outboard motor of the present invention.

Next, in the intake system 13, as depicted in FIG. 6, a single air cleaner 22 is disposed between respective engine units 11. On the other hand, as depicted in FIG. 8, with a front side of the cylinder head 19 of the right-side engine unit 11 and with a rear side of the cylinder head 19 of the left side engine unit 11, intake manifolds 23 are connected respectively, and the intake manifolds 23 and the air cleaner 22 are respectively connected via intake pipes 24. An intake pipe 25 is extended from a front surface portion of the air cleaner 22 to a hull 1 side of a front portion of the engine case 100 (see FIG. 9), thereby to take in air from an air intake port at a tip thereof. The air intake port is disposed in a chamber or a space which is not exposed to a wave, a splash, rain, or the like in the hull 1. As depicted in FIG. 7, in each engine unit 11, the single intake pipe 25 is branched into a plurality of (four, in this example) intake manifolds 23.

In the exhaust system 13, as depicted in FIG. 7 and so on, with a rear side of the cylinder head 19 of the right-side engine unit 11 and with a front side of the cylinder head 19 of the left-side engine unit 11, exhaust manifolds 26 are connected respectively, which are connected to a single exhaust pipe 27. An exhaust hose 28 is connected to the exhaust pipe 27 and a muffler 29 is connected to the exhaust hose 28. An exhaust hose 30 is connected to the muffler 29, so that exhaust gas is discharged from an exhaust outlet 31 mounted on the exhaust hose 30.

The muffler 29 is disposed in a lower surface outer side of the case main body 101 of the engine case 100. In such a case, the muffler 29, the exhaust hose 30, and so on are disposed in a manner not to protrude from a lower surface of the case main body 101 practically, and exhaust gas is exhausted from the exhaust outlets 31 disposed near lower portions in both right and left sides of a rear surface of the case main body 101 into water in a right and left well-balanced manner.

Figure 10:
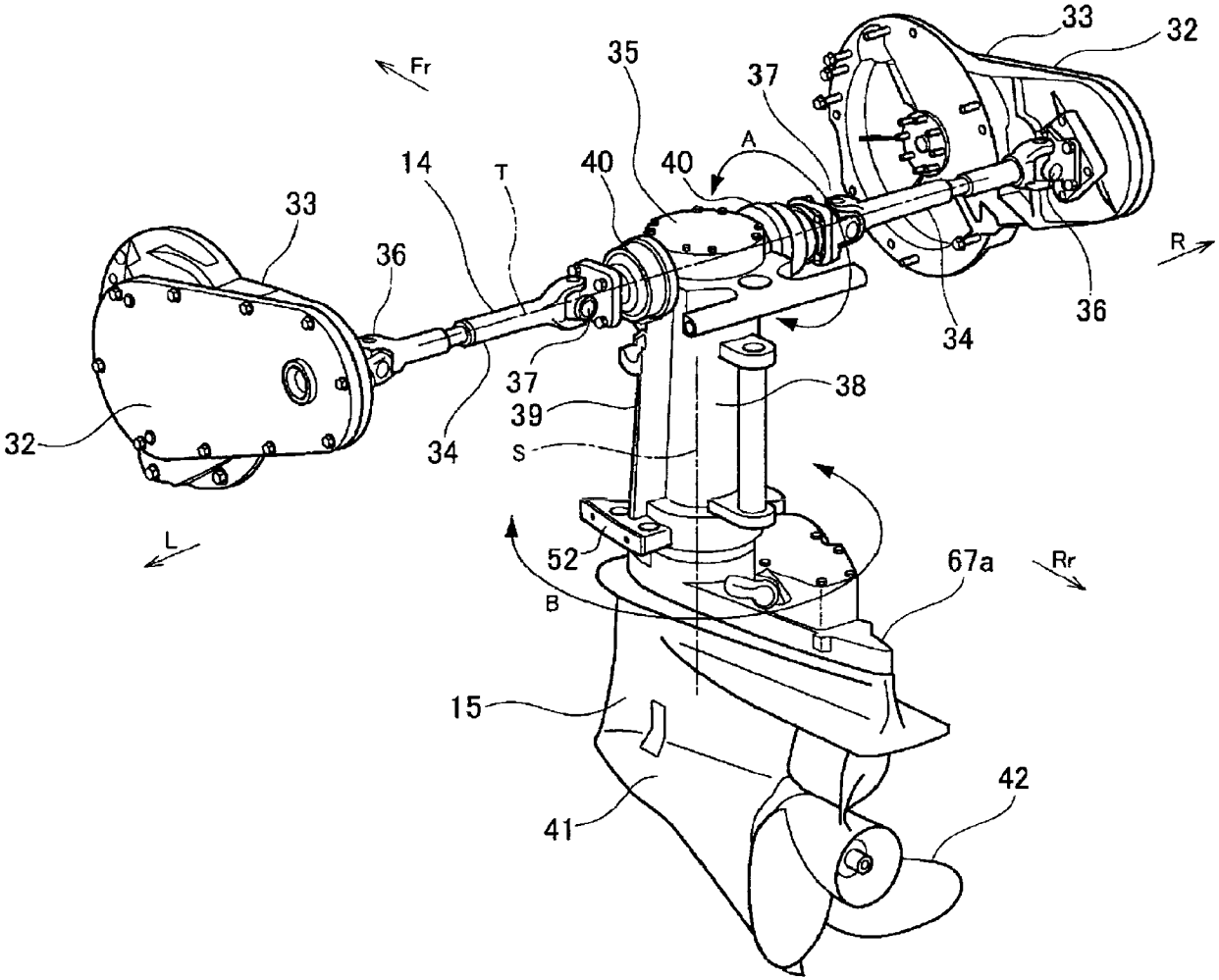
FIG. 10 is a perspective view depicting a constitution and disposition example of a power transmission mechanism of the outboard motor of the present invention.

The power transmission mechanism 14 transmits output of the engine unit 11 to the propulsion unit 15. In the power transmission mechanism 14, speed reducers 32 are linked to the engine output shafts of the right, and left engine units 11 as depicted in FIG. 10. The power transmission mechanism 14 has a gear group pivotally supported in a freely rotatable manner in a casing 33 of the speed reducer 32, and a tie rod 34 is linked to its output shaft. The right and left tie rods 34 are mutually concentric and horizontal and disposed in the right and left direct ion, and are linked to an intermediate speed reducer 35 at a right and left center portion. Each tie rod 34 is linked to the speed reducer 32 and the intermediate speed reducer 35 via universal joints 36, 37 in both ends, respectively.

In the present embodiment, the intermediate speed reducer 35 includes a pair of input side bevel gears respectively linked to the tie rods 34 and output side bevel gears engaged with the input side bevel gears. The output side bevel ear is linked to a drive shaft inside a drive shaft case 38, and the intermediate speed reducer 35, the drive shaft case 38, and a swivel bracket 39 are integrally connected with each other. The drive shaft is extended downward from the intermediate speed reducer 35. Those swivel brackets 39 and so on are pivotably supported by the case main body 101 via bearings 40 as will, be described later.

The propulsion unit 15 is disposed below the drive shaft case 38 as depicted in FIG. 10 and so on. The propulsion unit 15 includes a gear case 41 housing a gear for driving a propeller, and has a fin shape as a whole. A propeller 42 is mounted on a rear end portion of the gear case 41. The drive shaft is extended further downward through the inside of the drive shaft case 38 and is extended as far as in the gear case 41. A final speed reducer is constituted inside the gear case 41 and the propeller 42 can be rotationally driven via the final speed reducer.

Further, a tilt mechanism and a steering mechanism to the propulsion unit 15 are included. Detailed explanation regarding the above being omitted here, first, by the tilt mechanism, the intermediate speed reducer 35, the drive shaft case 38, and the propulsion unit 15 as a whole are pivotable in a vertical direction around a tilt shaft. The tilt shaft T is set coaxially with the tie rod 34, and the propulsion unit 15 can tilt operate around the tilt shaft T as indicated by an arrow A in FIG. 10. It is possible that in a tilt mechanism a driving device which is called a power trim tilt (PTT) or the like is included, constituting an electromotive hydraulic tilt mechanism.

Further, by the steering mechanism, as indicated by an arrow B of FIG. 10, the propulsion unit 15 is pivotable in a yaw direction (horizontal direction) around the steering shaft S (yawing). In such a steering mechanism, for example, by having a steering cylinder which is hydraulically driven in an electromotive hydraulic manner and by reciprocating the steering cylinder along a steering rod by using a hydraulic pump as a hydraulic source, the propulsion unit 15 can pivot in the horizontal direction, that is, can steering operate.

Figure 11:
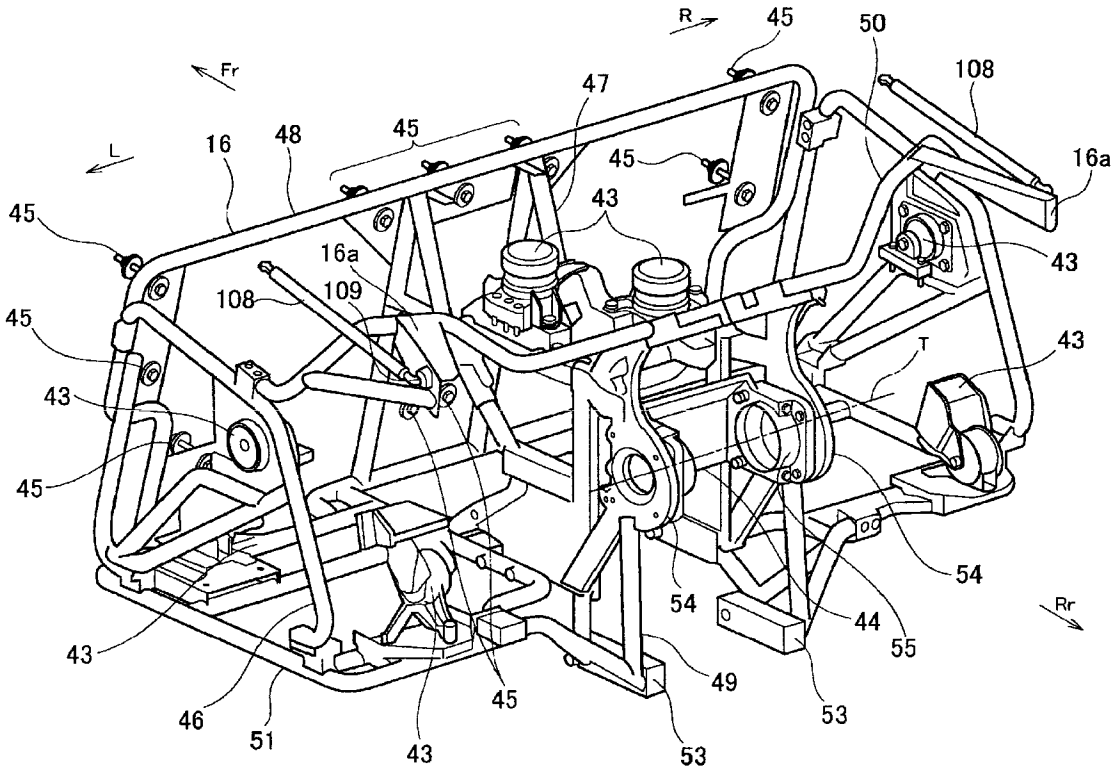
FIG. 11 is perspective view depicting a constitution and disposition example of a frame of the outboard motor of the present invention.

The above-described main composing members of the outboard motor 10 are mounted and supported on the frame 16 as in FIG. 6. The frame 16 is formed by using a material such as a steel pipe, in a manner to have an external shape almost taking along the rectangular parallelepiped of the casing constituting the engine case 100 as depicted in FIG. 11. In a predetermined part of the frame 16 is provided a plurality of engine mounts 43 to mount and support the engine unit 11, and the engine unit 11 is mounted on the frame 16 via the engine mounts 43. Further, in a rear portion of the frame 16, there is installed a main bracket 44 on which the bearing 40 for supporting the aforementioned swivel bracket 39 and so on are mounted.

Further, a plurality of transom bolts 45 are mounted on a front surface portion of the frame 16 in a manner to face the front. The outboard motor composing members such as engine units 11 are mounted on the frame 16, and the frame 16 on which the composing members are mounted is housed in the engine case 100. The transom bolt 45 penetrates a front surface portion of the case main body 101 of such an engine case 100 and fastened to the transom board 2, and thereby the engine case 100 as a whole can be fastened and fixed to the transom board 2. It should be noted that a seal, a packing, or the like is installed in the transom bolt 45 protruding from the case main body 101, so that water tightness is secured.

As described above, the engine case 100 has the case main body 101 housing the engine unit 11 and its peripheral components, and the case cover 102 which covers the upper opening 101*a* of the case main body 101. As a result that the case cover 102 closes to the case main body 101, the inside of the engine case 100 practically becomes a sealed space, so that high water tightness can be secured. In this case, the composing members of the outboard motor 10 are supported by the frame 16, and the frame 16 holds the engine unit 11 and is in charge of a propulsive force and a steering force of the propulsion unit 15, that is, the engine case 100 itself is not subjected to an applied load thereof. Further, the engine case 100 also functions as an exterior member of the outboard motor 10 as depicted in FIG. 1, and is mounted on the outboard motor 10, exhibiting an external appearance having a sense of unity as a whole.

As depicted in FIG. 2 to FIG. 4, in a rear surface side of the case main body 101, in a region from its rear surface portion to a bottom surface portion, there is provided a recessed portion 103 formed in a manner to be recessed toward the inside of the case main body 101 in a beam direction center portion. The propulsion unit 15 and its tilt and steering mechanism and so on constituting a propulsion device are disposed in a neighborhood of the recessed portion 103. The recessed portion 103 is formed from the rear surface side of the case main body 101 toward the front, and a necessary and sufficient space is provided so that the tilt mechanism and the steering mechanism or their peripheral equipment or members do not interfere with the case main body 1 at a time of tilt or steering operation.

As described above, equipment such as a fuel tank, a battery and so on is placed in the hull 1 side and such equipment and the outboard motor 10 are connected or linked. In this case, as depicted in FIG. 5, a plurality of through holes 104 are formed in a manner to bore holes in common between the front surface portion of the casing 101 and the transom board 2. In other words, the through hole 104A for making the intake pipe for supplying air for combustion to the engine inserted through, the through hole 104B for making the fuel pipe for supplying fuel from the fuel tank to the engine inserted through, the through hole 104C for making a ventilation air cylinder for ventilating the inside of the engine case 100 run through, and so on are formed. Further, there is formed the through hole 104D for making a code or a cable or the like which electrically (including a control signal, etc.) or mechanically connects the device or the equipment or the member in the engine case 100 and the driving device in the hull 1 side inserted through. It should be noted that a water-tightening means (seal or the like) is applied to those through holes 104 at a time of mounting of the intake tube 25 and so on.

The case cover 102 constitutes an upper surface portion of the engine case 100, and as depicted in FIG. 2 or FIG. 3, is pivotably connected near a rear portion upper end of the case main body 101 via a hinge 105. As a result that the case cover 102 is opened by being pivoted around the hinge 105 as in FIG. 12, the inside of the engine case 100 is opened, whereby the engine unit 11 and so on inside the exposed engine case 100 can be freely accessed. It is possible to open the case cover 102 and perform inspection or the like of the inside easily, so that convenience of an operation of such a kind can be improved.

Figure 12:
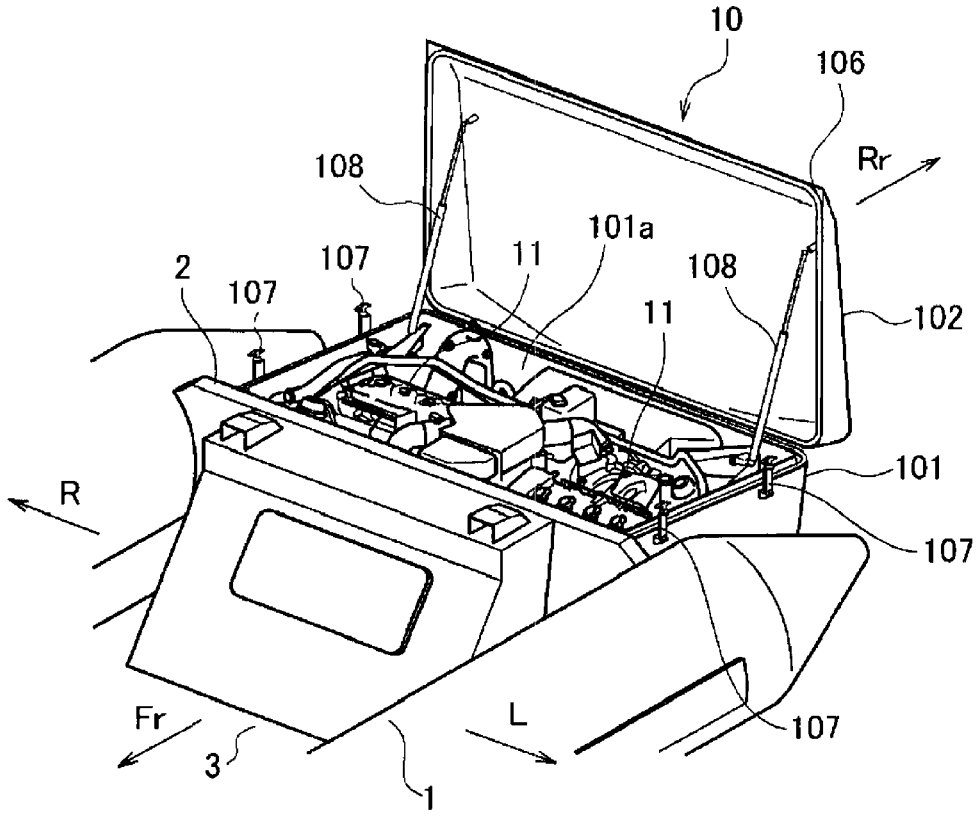
FIG. 12 is a perspective view depicting an open state of a case cover in the engine case of the outboard motor of the present invention.

A seal 106 is laid to a closing portion or a coupling surface of the case main body 101 and the case cover 102 as depicted in FIG. 12, and by closing the case cover 102 to the case main body 101, high water tightness of the engine case 100 is secured and held. In this case, the seal 106 is laid to the whole circumference along the coupling surface of the case main body 101 and the case cover 102. Then, when the case cover 102 is closed, the seal 106 is nipped between the closing portion of the case main body 101 and the case cover 102, whereby high water tightness to the engine case 100 can be obtained. Further, there is a locking mechanism 107 depicted in FIG. 12 which fixedly maintains the case cover 102 in a closed state when the case cover 102 is closed to the case main body 101.

Further, there is included a holding mechanism capable of holding the case cover 102 in an opened state, and it is possible to hold the case cover 102 in a state of being opened to the case main body 101, as in FIG. 12. In a concrete constitution of the holding mechanism, as in FIG. 12, a hydraulic damper 108 is disposed near the opening portion 101*a* of the case main body 101. The hydraulic damper 108 is connected between the case cover 102 and the frame 16. Here, with reference to FIG. 11, a right and left pair of supporting arms 16*a* are included in an upper rear of the frame 16, and one end of each hydraulic damper 108 is linked and supported by the supporting arm 16*a* via a swivel 109. The other end of the hydraulic damper 108 is similarly linked to a rear side of the case cover 102 via a swivel.

As described above, the engine unit 11 is mountedly supported by the frame 16 via the engine mount 43. Here, the frame 16 includes, concretely as depicted in FIG. 11, right and left side frames 46, an inner frame 47 almost corresponding to the recessed portion 103 in the beam direction, a front frame 48 in the front, a rear frame 29 in the rear, an upper frame 50 in the upper portion, and a lower flame 51 in the lower portion, which are constituted by pipe members and plate members, and further, thick wall parts. These members are combined by bolt-connecting or the like, and are connected with each other.

Figure 13:
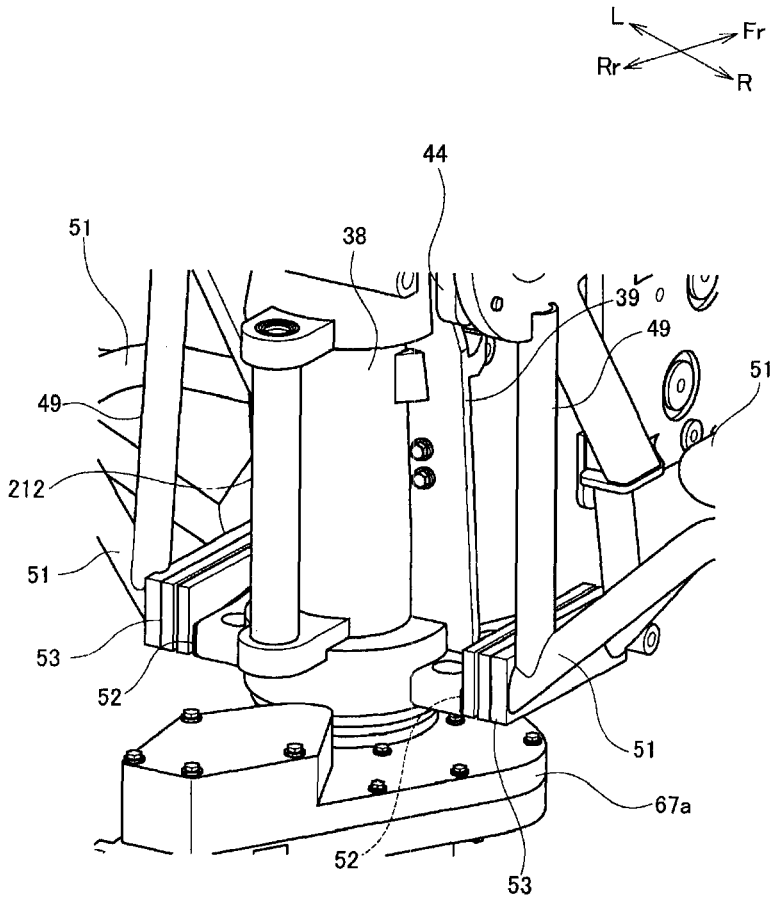
FIG. 13 is a partial perspective view depicting a surrounding of a guide mechanism of a swivel bracket in the outboard motor of the present invention.

The frame 16 of the inner side of the case main body 101 is also formed to be recessed in correspondence with the recessed portion 103 formed in the rear surface side of the case main body 101. In this case, parts corresponding to the recessed portion 103 of the rear frame 49 and the lower frame 51 are extended downward or inclined obliquely, and thereby the frame 16 has a truss structure as can be understood from FIG. 13. With reference to FIG. 13 and so on, in a lower portion of the swivel bracket 39, there are attached, to both right and left sides thereof, pads 52 to contact a case main body 101 side when the propulsion unit 15 tilt operates. On the other hand, to a truss structure part of the frame 16, pads 53 corresponding to the pads 52 are attached. By providing such pads 52, 53, the propulsion unit 15 is guided from both the right and left sides.

As described above, the swivel bracket 39 is pivotably supported by the frame 16 is the bearings 40. Further, as depicted in FIG. 11, in the rear portion of the frame 16 is mounted and supported the main bracket 44 in which the bearings 40 for pivotably supporting the swivel bracket 39 are installed. A pair of donut-shaped flange portions 54 for mounting the main bracket 44 on is provided on a rear portion center of the frame 16. Though the case main body 101 is not depicted in FIG. 11, the case main body 101, more concretely, side walls of the recessed portion 103, stands in a manner to be sandwiched by the main bracket 44 and the flange portions 54.

The main bracket 44 is formed in a U-shape in plain view (FIG. 11 and so on), and has bearing housings 55 (shaft receiving portion) in which the bearings 40 are installed in both right and left side portions of the U-shape. As described above, since the main bracket 44 including the right and left bearing housings 55 is integrally formed in the U-shape as a whole, it is possible to support the swivel bracket 39 at high stiffness. Accordingly, quick turning and tilt (trim) operation during turning can be performed smoothly and in a short time.

Figure 14:
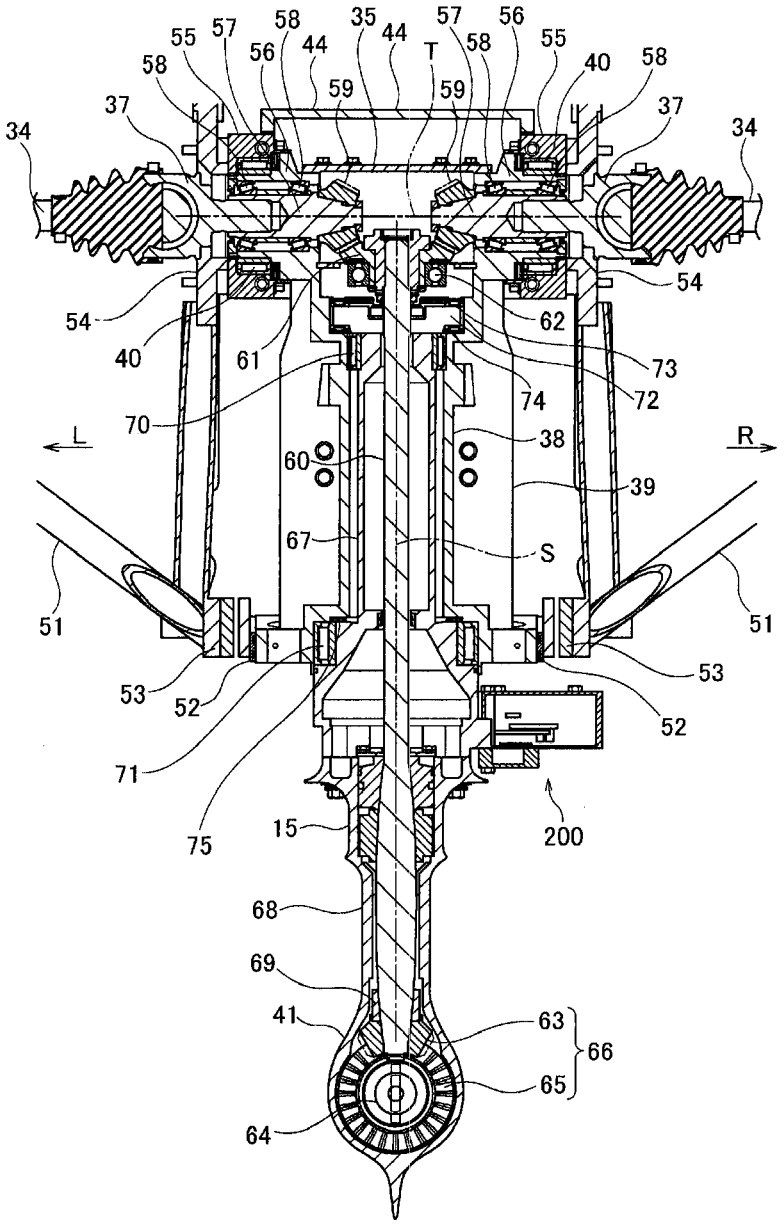
FIG. 14 is a vertical cross-sectional view depicting a constitution example in a power transmission system of the outboard motor of the present invention.

Here, FIG. 14 depicts a constitution example along a power transmission path from the intermediate speed reducer 35 to the propulsion unit 15, the power transmission path being supported via the swivel bracket 39. In both right and left shoulder portions of the swivel bracket 39 are formed tilt suspension portions 56 of hollow cylindrical, shapes coaxial with the tilt shaft T. The bearings 40 are installed in the tilt suspension portions 56 and the bearings 40 are further fit into the bearing housings 55 from both sides as described above. In this manner, the swivel bracket 39 is pivotably supported around the tilt shaft T via the bearings 40 in the tilt suspension portions 56, whereby the entire swivel bracket 39 can tilt-operate smoothly.

Further, inside respective tilt suspension portions 56, a pair of input shafts 57 to the intermediate speed reducer 35 are supported in a freely rotatable manner via bearings 58, coaxially with the tilt shaft T. The tie rod 34 is linked to one end side of the input shaft 57 via the universal joint 37. Further, a bevel gear 59 being a pinion gear is mounted on the other end side of each input shaft 57. On the other hand, inside the drive shaft case 38 integrally connected with the swivel bracket 39, a drive shaft 60 is insertedly supported rotatably, and a bevel gear 61 mounted on an upper end of the drive shaft 60 is supported in a freely rotatable manner via a bearing 62. The bevel gear 61 is engaged in both the bevel gears 59 disposed to face each other. As described above, in the intermediate speed reducer 35, a power inputted from the tie rod 34 to the input shaft 57 is transmitted to the drive shaft 60 via the bevel, gear 59 and the bevel gear 61, and thereby the drive shaft 60 is rotationally driven.

The drive shaft 60 is further extended to the gear case 41 passing through the inside of the propulsion unit 15, and on a lower end thereof, a bevel gear 63 being a pinion gear is mounted. In the gear case 41, a propeller shaft 64 on which the propeller 42 is mounted is rotatably supported, and a bevel gear 65 mounted on the propeller shaft 64 is engaged in the bevel gear 63. As described above, the final speed reducer 66 is constituted by the bevel gear 63 and the bevel gear 65 in the gear case 41, and it is constituted that the propeller 42 is rotated via a power transmission system from the intermediate speed reducer 35 to the final speed reducer 66 as above.

Further, in the drive shaft case 38, with reference to FIG. 14, a drive shaft housing 67 coaxial with the drive shaft. 60 is supported in a freely rotatable manner and the drive shaft 60 penetrates through the inside of the drive shaft housing 67. A lower case 68 is connected with a lower portion of the drive shaft housing 67. It should be noted that the gear case 41 is provided in a lower portion of the lower case 68. A lower end of the drive shaft 60 is supported in a freely rotatable manner by the lower case 68 via a bearing 69.

The drive shaft housing 67 is generally formed in a cylindrical shape, and is rotatably supported by the drive shaft case 33, that is, by a swivel bracket 39, near its upper end and lower end via bearings 70, 71, respectively. The drive shaft housing 67 is integrally connected with the lower case 68 as described above, and by an action of a steering device 200 depicted in FIG. 14 the drive shaft housing 67 and the lower case 68 pivots around the steering shaft S so that steering operation is performed. Further, a thrust pad 72 is disposed in an upper end of the drive shaft housing 67. Further, bearings 73, 74 are installed above and below the thrust pad 72 and a bearing 75 is installed near a lower portion of the drive shaft housing 67, and it is constituted that a thrust direction load is received by those swivel vertical axis thrust bearings.

In the above-described case, in addition to the aforementioned composing members of the outboard motor 10, there is routed, in a proper place in the engine case 100, an electric signal line or a code or the like for transmitting/receiving an electric signal, an electric power or the like between a cooling pipe system, a hydraulic pipe system for driving of a tilt mechanism and a sneering mechanism, or mutual members or the like, of the engine unit 11, and an auxiliary machine or the like necessary for driving of the outboard motor 10 is provided. Then, via those pipe systems and so on, or by operation of the auxiliary machine or the like, proper driving of the outboard motor 10 is performed.

Here, in basic operation of the outboard motor 10 of the present invention, output of two engine units 11 disposed side by side inside the engine case 100 is transmitted through the power transmission mechanism 14 to the propulsion unit 15 disposed outside the engine case 100. More concretely, when the engine unit 11 activates, its power is first inputted to the speed reducer 32, and next transmitted from its output terminal to the tie rod 34 via the universal joint 36. The engine power is further transmitted from the tie rod 34 to the intermediate speed reducer 35, and in the intermediate speed reducer 35, the engine power is transmitted from the input shaft 57 to the drive shaft 60 via the bevel gear 59 and the bevel gear 61, whereby the drive shaft 60 is rotationally driven, driving force of the drive shaft 60 is transmitted, in the final speed reducer 66 in the gear case 1, to the propeller shaft 64, and further to the propeller 42 via the bevel gear 63 and the bevel gear 65, and thereby the propeller 42 rotates.

Figure 15:
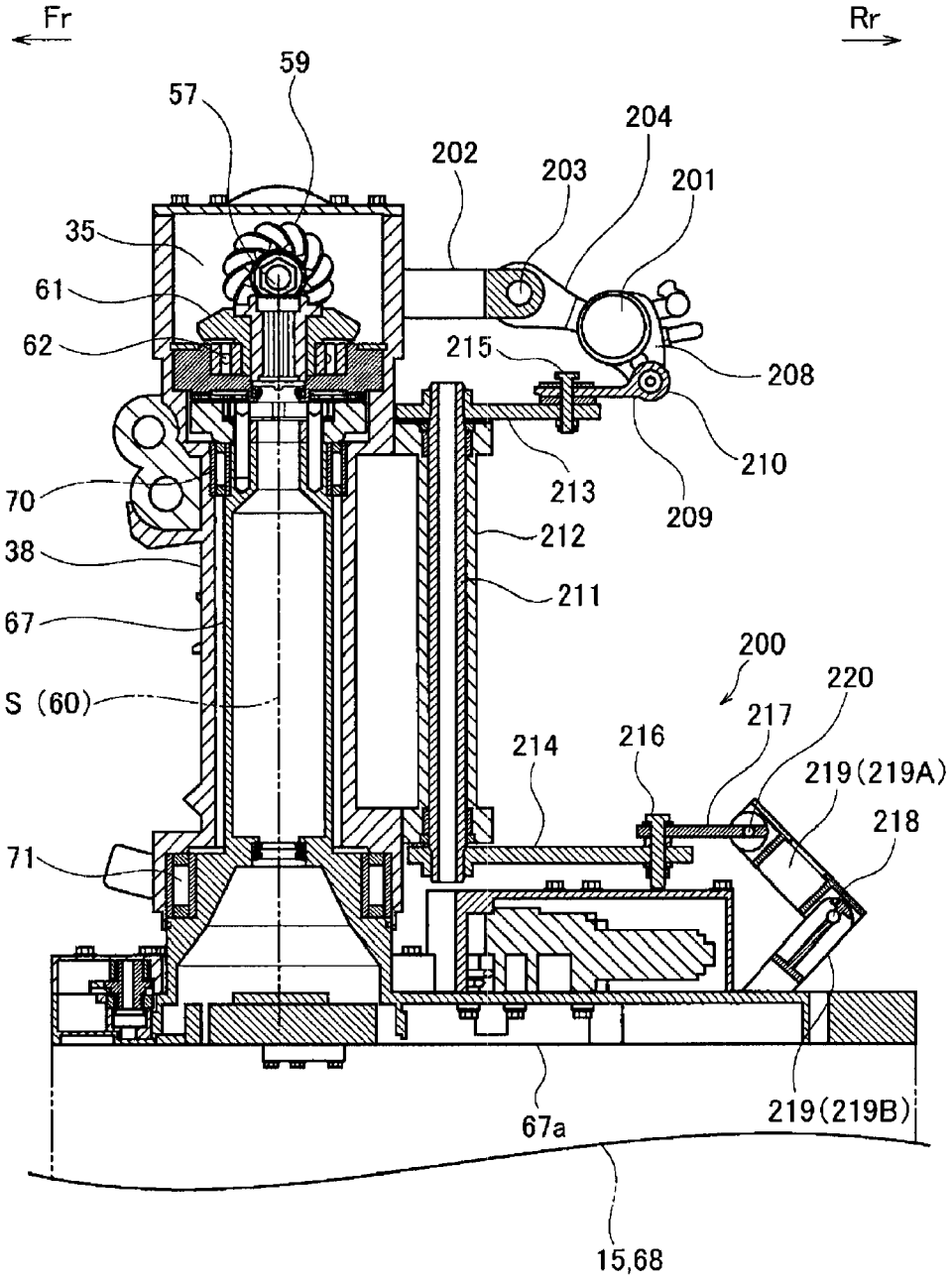
FIG. 15 is a vertical cross-sectional view depicting a constitution example of a steering device of the outboard motor of the present invention.

FIG. 15 depicts a configuration example of surroundings of the steering device 200. First, as described above, in a center portion of the swivel bracket 39, the drive shaft housing 67 of the cylindrical shape is disposed in the drive shaft case 38, and the speed reducer 35 is disposed thereabove. The lower portion of the drive shaft housing 67 is connected with the lower case 68 constituting a casing of the propulsion unit 15, that is, an extended portion 67*a* is extended from a lower end of the drive shaft housing 67 toward the rear in a manner to cover an upper portion of the lower case 68, and the lower portion of the drive shaft housing 67 is connected with the lower case 68 by the extended portion 67*a*.The extended portion 67*a* is pivotally supported around the steering shaft S integrally with the drive shaft housing 67, and thus, the lower case 68, that is, the propulsion unit 15 is also clockwise/counterclockwise turnable around the steering shaft S together with the extended portion 67*a*.

Figure 16:
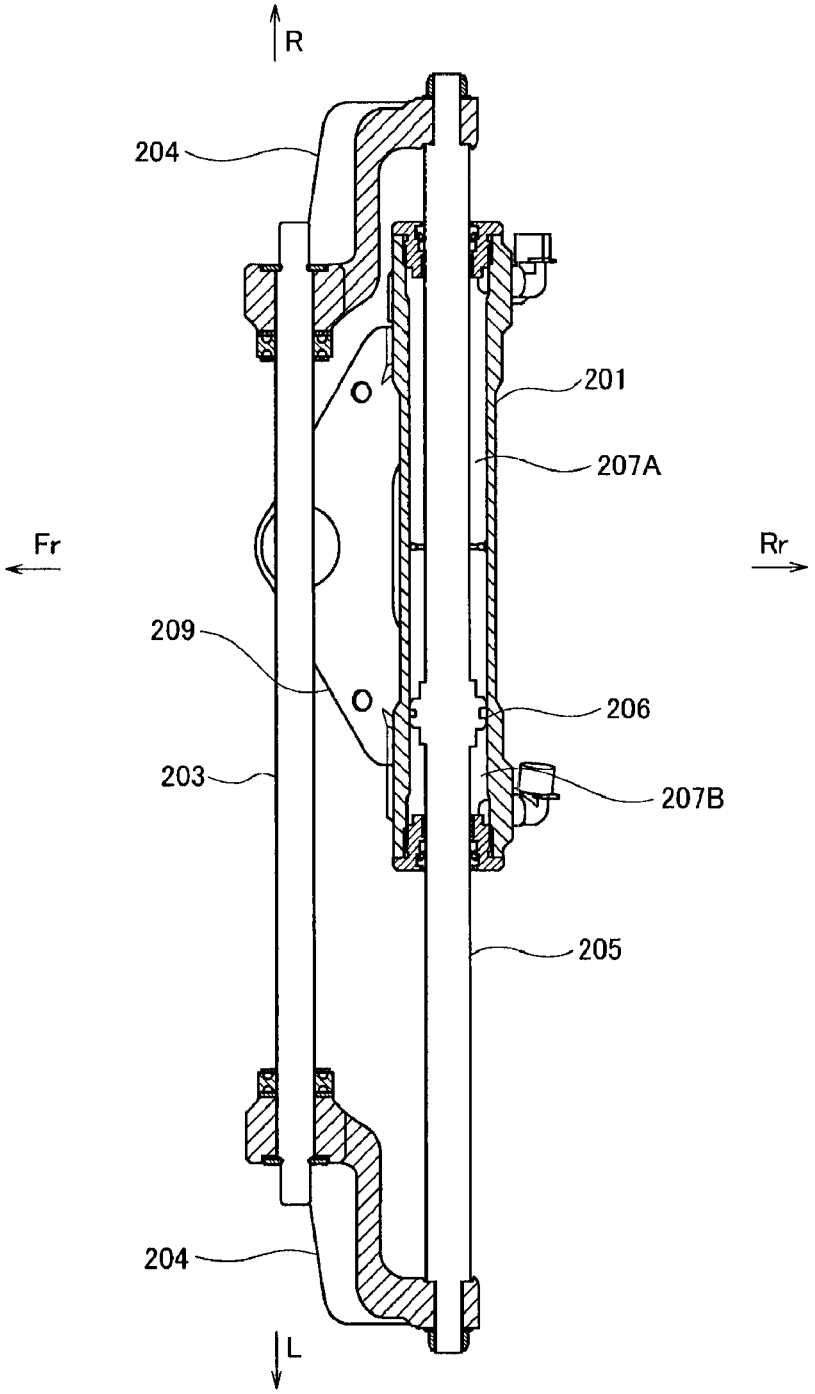
FIG. 16 is a cross-sectional view of a surrounding of a driving section of the steering device of the outboard motor of the present invention.

In the steering device 200 of the present embodiment, a hydraulic cylinder is used as a driving source thereof. With reference to FIG. 2 and FIG. 3, a hydraulic cylinder 201 is horizontally disposed near a rear side upper portion of the swivel bracket 39. More concretely, as in FIG. 15 and FIG. 16, a fix rod 203 extendedly provided in a right and left horizontal direction is insertedly supported by stays 202 provided projectingly toward the rear near an upper portion of the drive shaft case 38. A fix shaft 205 is disposed in parallel, with the fix rod 203 via arms 204 mounted on both end portions of the fix rod 203. The hydraulic cylinder 201 is slidably installed in the fix shalt 205. A stationary piston 206 compartmentalizing the inside of the hydraulic cylinder 201 is provided in a center portion of the fix shaft 205, and pressure chambers 207A, 207B of the hydraulic cylinder 201 are formed in both sides of the piston 206. The pressure chambers 207A, 207B are supplied with operating oil having a hydraulic pressure of a predetermined pressure at a time of steering operation.

Swivel arms 209 are attached to the hydraulic cylinder 201 via brackets 208 mounted on both end portions thereof. The swivel arms 209 are pin-connected with the respective brackets 208 by a supporting shaft 210 thereof and are pivotable around the supporting shaft 210. Here, a housing 212 for supporting a steering sub-shaft. 211 is disposed in a rear side of the drive shaft case 38 in parallel. The steering sub-shaft 211 is rotatably supported in the housing 212, and steering levers 213, 214 are mounted on their upper and lower end portions. The steering lever 213 of an upper side is pin-connected with the swivel arm 209 via a linking pin 215, in correspondence with a reciprocating motion of the hydraulic cylinder 201 along the fix shaft 205, and the steering lever 213 pivots in the right or in the of around the steering sub-shaft via the swivel arm 209.

The steering lever 214 of a lower side is pin-connected with a swivel arm 217 via a linking pin 216. A steering arm 219 constituted by steering arms 219A, 219B bendably connected with each other via a linking pin 218 is disposed on the extended portion 67*a* of the drive shaft housing 67. The steering arm 219A of an upper side is pin-connected with the swivel arm 217 via a supporting shaft 220. The upper and lower respective steering levers 213, 214 synchronously pivot, and by such pivot the extended portion 67*a*, therefore, the lower case 68 and the propulsion unit 15 are turned in the right or in the left via the swivel arm 217 and so on.

Figure 17A:
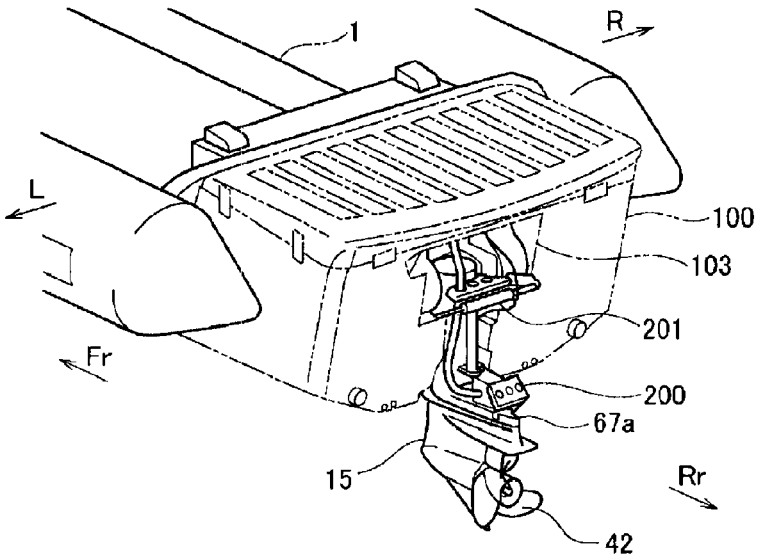
FIG. 17A is a rear perspective view, at a time of straight traveling of a boat, of the steering device of the outboard motor of the present invention.
Figure 17B:
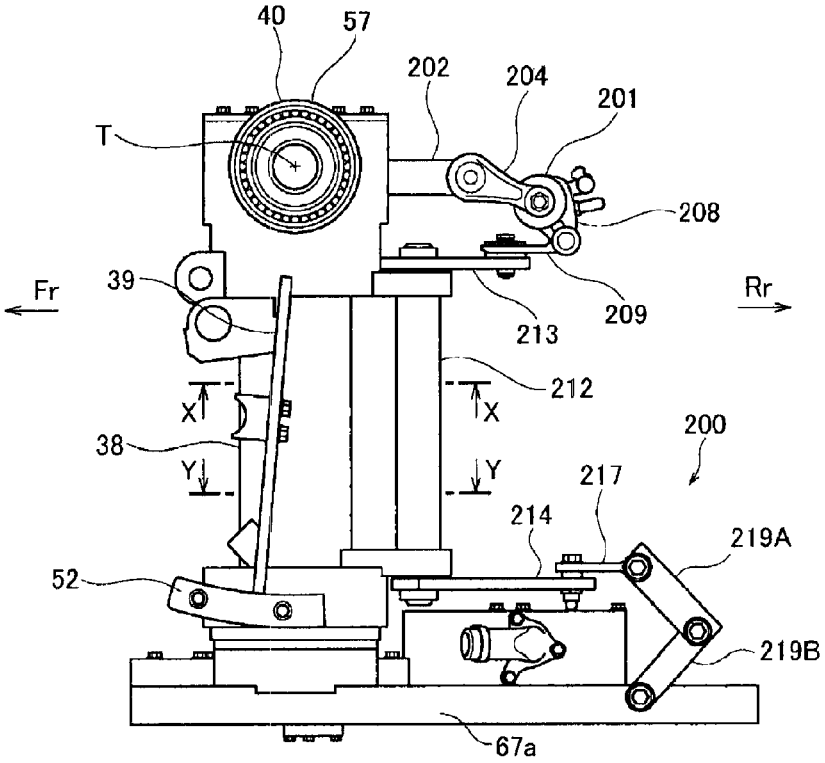
FIG. 17B is a side view, at the time of straight traveling of the boat, of the steering device of the outboard motor of the present invention.
Figure 18A:
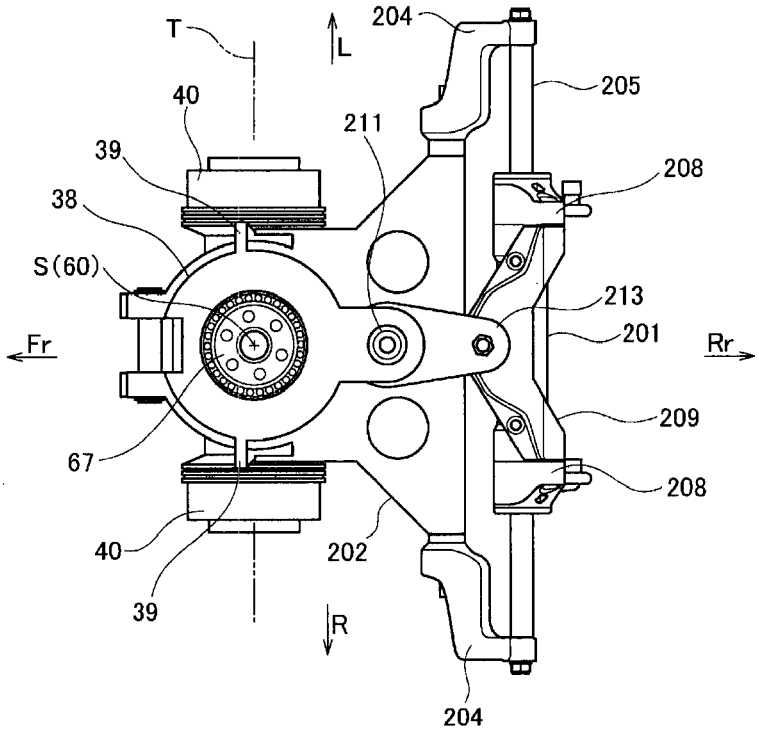
FIG. 18A is an X-direction arrow view of FIG. 17B.
Figure 18B:
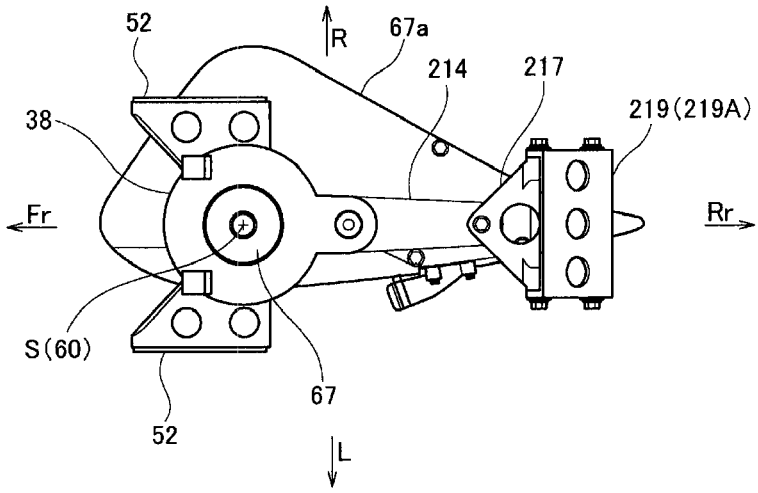
FIG. 18B is a Y-direction arrow view of FIG. 17B.

Next, an action or the like of the steering device 200 according to the present invention will be described. First, in a case that the outboard motor 10 is not turned, that is, in a case that a boat travels straight, the steering device 200 is in a neutral state as depicted in FIG. 17A and FIG. 17B, the propulsion unit 15 and the propeller 42 being straightly directed to the rear. At this time because of the fact that a hydraulic balance between the right and left pressure chambers 207A, 207B is in equilibrium, the hydraulic cylinder 201 is positioned in a shaft direction center portion of the fix shaft 205 as in FIG. 18A. Further, the upper and lower steering levers 213, 214 are both directed to the rear.

Figure 19A:
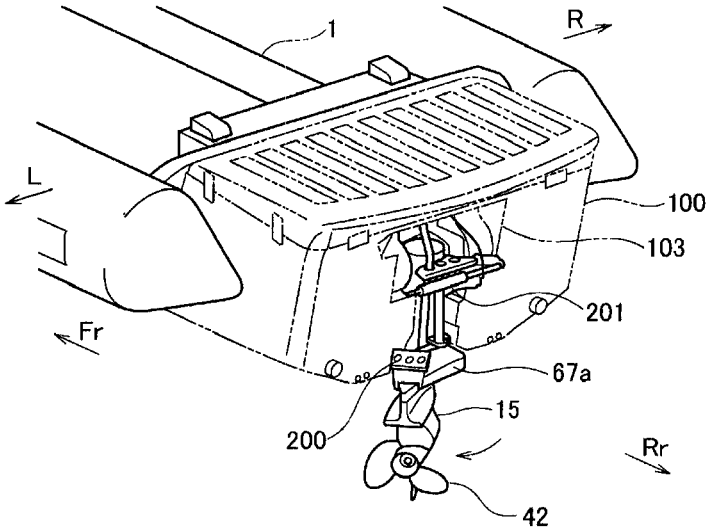
FIG. 19A is a rear perspective view, at a time of left turning of the boat, in the steering device of the outboard motor of the present invention.
Figure 19B:
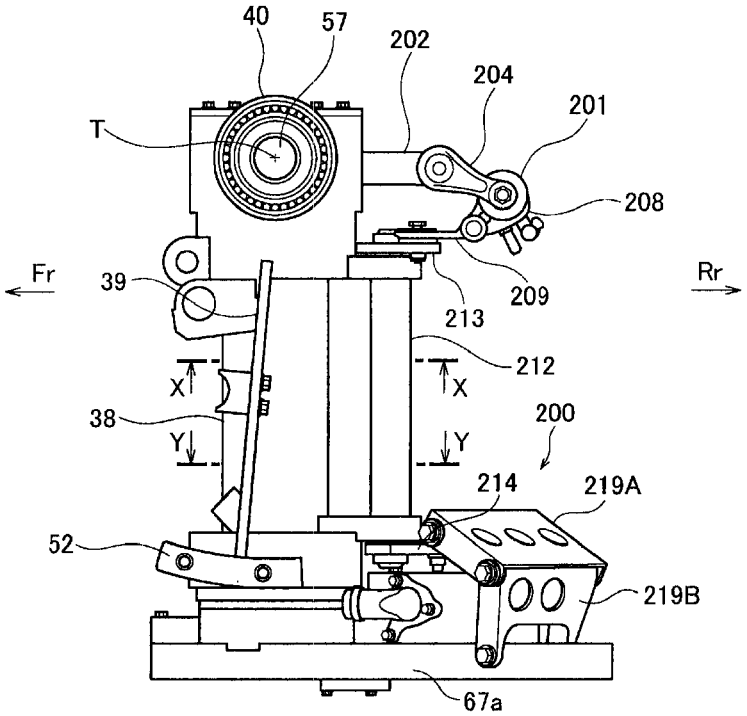
FIG. 19B is a side view, at the time of left turning of the boat, in the steering device of the outboard motor of the present invention.
Figure 20A:
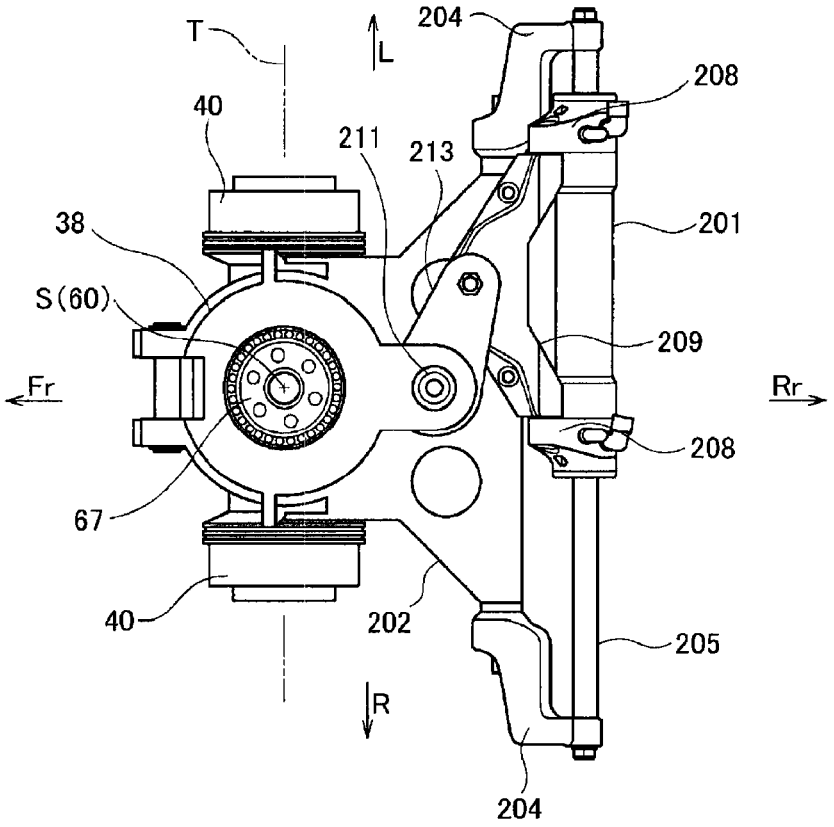
FIG. 20A is an X-direction arrow view of FIG. 19B.

Further, in a case that the outboard motor 10 is turned to the left, that is, in a case that the boat is turned leftward, the steering device 200 is pivoted to the left as depicted in FIG. 19A and FIG. 19B, the propulsion unit 15 and the propeller 42 are directed to the left rear in relation to the hull 1. On this occasion, the pressure chamber 207B of the left side comes to have a higher pressure than the pressure chamber 207A of the right side, and as in FIG. 20A the hydraulic cylinder 201 moves leftward along a shaft direction of the fix shaft 205 and the steering lever 213 of an upper side pivots to the left. It should be noted that concurrently with pivot of the steering lever 213 a distance with the fix shaft 205 changes, that is, as in FIG. 20A the steering lever 213 comes apart from the fix shaft 205. In this case, as a result that the hydraulic cylinder 201 itself rotates around the fix shaft 205 via the bracket 208, smooth operation is secured without applying an unnecessary restraint load to the steering lever 213, so that the above distance change is effectively coped with.

Figure 20B:
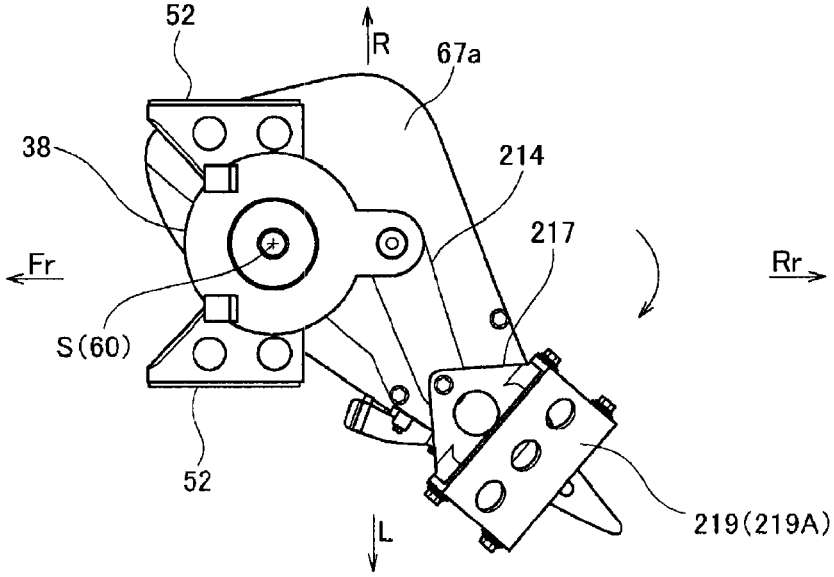
FIG. 20B is a Y-direction arrow view of FIG. 19B.

As a result that the steering lever 213 pivots, to the left, the steering lever 214 of the lower side also pivots to the left via the steering sub-shaft 211 as in FIG. 20B. Then, by pivot of the steering lever 214, the lower case 68, accordingly, the propulsion 15, is turned to the left via the swivel arm 217. It should be noted that the steering shaft S and a shaft of steering link system, that is, a shaft of the steering sub-shaft 211 are apart from each other. Thus, a distance between a point of action of the drive shaft housing 67 and the steering sub-shaft 211 changes as a result that the steering angle changes as described above. For soon a change, the steering arms 219A, 219B bendably connected with each other appropriately bend in a vertical direction, whereby effective response thereto can be done.

Figure 21A:
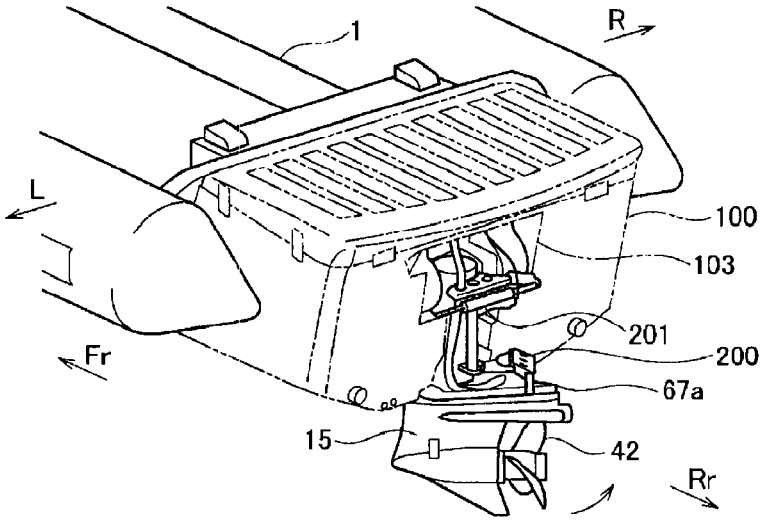
FIG. 21A is a rear perspective view, at a time of right turning of the boat, in the steering device of the outboard motor of the present invention.
Figure 21B:
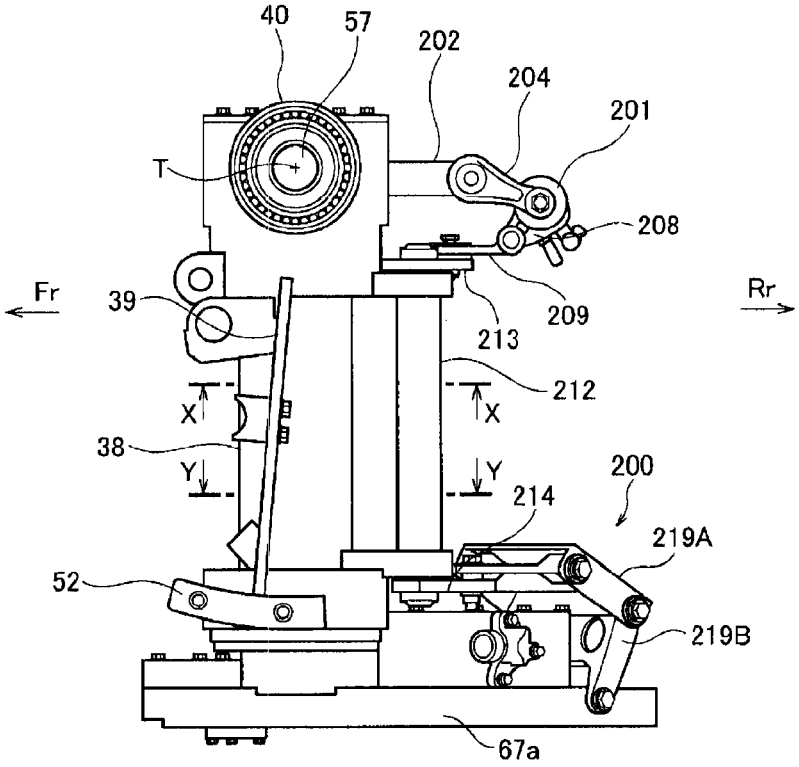
FIG. 21B is a side view, at the time of right turning of the boat, in the steering device of the outboard motor of the present invention.
Figure 22A:
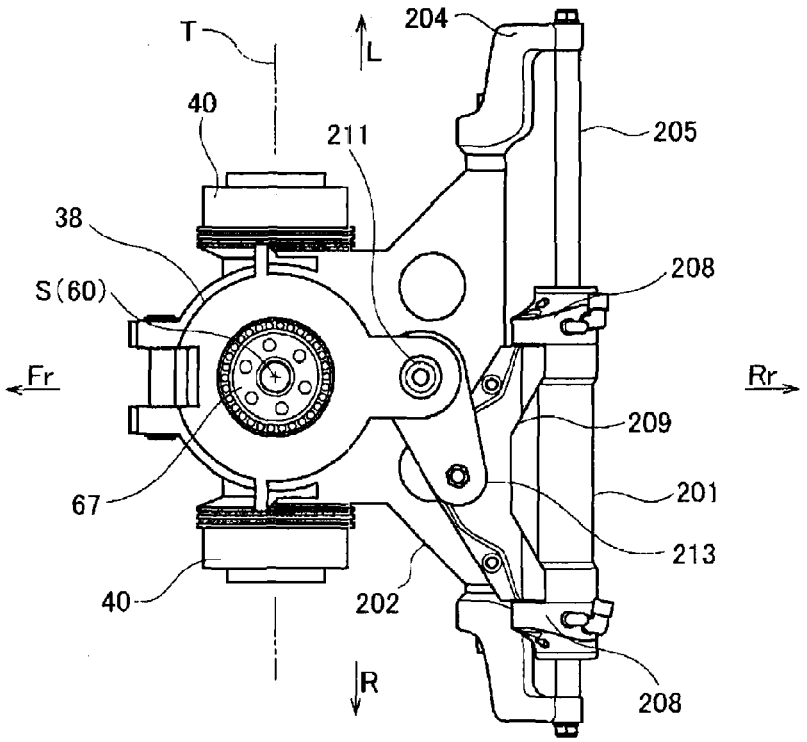
FIG. 22A is an X-direction arrow view of FIG. 21B.
Figure 22B:
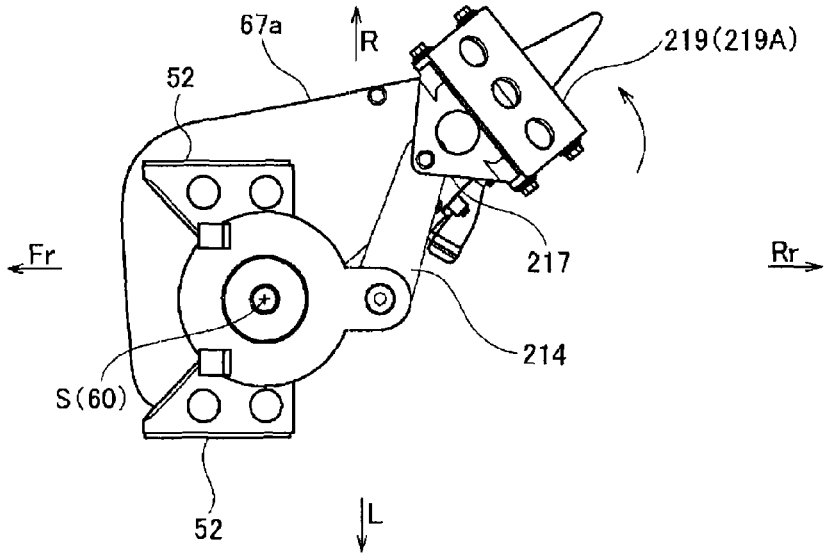
FIG. 22B is a Y-direction arrow view of FIG. 21B.

Further, in a case that the outboard motor 10 is turned to the right, that is, in a case that the boat is turned rightward, the steering device 200 pivots to the right as depicted in FIG. 21A and FIG. 21B, and the propulsion unit 15 and the propeller 42 are directed to the right rear in relation to the hull 1 On this occasion, the pressure chamber 207A of the right side comes to have a higher pressure than the pressure chamber 207B of the left side, and the hydraulic cylinder 201 moves rightward along the shaft direction of the fix shaft 205 as in FIG. 22A, and the steering lever 213 of the upper side pivots to the right. Then, as a result that the steering lever 213 pivots to the right, the steering lever 214 of the lower side also pivots to the right via the steering sub-shaft 211 as in FIG. 22B, whereby the propulsion unit 15 is turned to the right.

Incidentally, in the case that the outboard motor 10 is steered to the right, the hydraulic cylinder 201 itself rotates around the fix shaft 205 via the bracket 208 as described above, or the steering arms 219A, 219B appropriately bend in the vertical direction. Thereby, smooth operation of the steering device 200 is assured.

As described above, in the present invention, by matching axes of the steering shaft S and of the drive shaft 60, the steering angle is made large, while the steering device 200 is constituted by the peripheral member of the drive shaft 60, in particular, an outer side member of the swivel bracket 39. Accordingly, a simple structure is available at the same level as that of a conventional outboard motor, without complicating a structure of the inside of the swivel bracket 39 where numerous components or members including the drive shaft 60, a radial bearing, a thrust bearing, an oil seal and so on gather.

Further, a steering angle of a conventional large-sized outboard motor of 300 horse-power class is about ±30 degree at the most, while a steering angle enabled by the steering device of the present invention is as large as ±40.In other words, by making axes of the steering shaft. S and of the drive shaft 60 common, it becomes possible to practically eliminate a limitation on a steering angle as in a conventional small-sized outboard motor. Incidentally, if the steering angle is enlarged, the extended portion 67*a* of the drive shaft housing 67 sometimes interferes with the recessed portion 103 of the engine case 100 unless a counter major is employed. Thus, it is preferable that the steering shaft is about ±30 in an actual device, but by making a position of the drive shaft housing 67 lower than a lower end of the engine case 100, interference therebetween can be avoided, so that a larger steering angle can be obtained.

Further, in the steering device 200, movable members changing directions at a time of steering are practically only the drive shaft housing 67 and the lower case 68. Accordingly, while securing a larger angle than a steering angle of the conventional large-sized outboard motor having the steering angle larger than that of a stern drive, the engine is not integrally steered as in the conventional outboard motor, so that an inertia moment in a yaw direction (steering angle direction) can be made smaller, enabling an operational load at a time of quick steering or the like to be decreased. Further, since it is constituted that a lateral direction load is received by the frame 16 (in particular, the truss structure constituted by the rear frame 49 and the lower frame 51) of a high rigidity in the lower portion of the swivel bracket 39, a quick turn by quick steering or a large steering angle is made possible, so that a travel performance can be substantially improved.

Here, further, characteristic operation and effect of the present invention will be described. First, by matching axes of the steering shaft S and of the drive shaft 60, the limitation of the steering angle is eliminated, so that a steering performance can be improved. It should be noted that in a case of an inboard motor, since steering is basically performed by a helm, a steering performance is not preferable. In cases of an inboard-outdrive motor and a large-sized outboard motor, since a steering shaft and a drive shaft do not match and a steering angle is limited, a steering performance is not preferable as well.

The steering performance will be described concretely. For example, a lift generated in the gear case 41 at the time of steering has its center almost on the shaft (about ⅓ from the front of the whole length) of the drive shaft 60. In this case, a steering moment of "lift force×(distance of steering center to lift force center)" is generated to the steering shaft S. When the axes of the steering shaft S and of the drive shaft 60 match, the steering moment becomes almost zero. Accordingly, a small steering drive force suffices, so that a device constitution can be made compact. Incidentally, in a general outboard motor, since an engine itself is also steered, a steering inertia moment becomes large, requiring large steering input. In the steering device 200 of the present invention, since small steering input suffices, there is an advantage that an operation can be done lightly.

Hereinabove, the present invention is described with various embodiments, but the present invention is not limited to those embodiments and may he implemented in various forms within the scope of the present invention.

In the above embodiment, though a plurality of bearings or shaft receivers supporting a plurality of rotation shafts such as an input shaft 57 and a drive shaft 60 is used, the number, format and so on can be appropriately selected in accordance with largeness or kinds of loads applied to those rotation shafts.

According to the present invention, by matching a steering shaft and a drive shaft, it is possible to constitute a steering device itself to he small and compact while making a steering angle larger. Further, according to the steering device of the Present invention, it is possible to realize a superior operability and a high steering performance.

What is claimed is:

1. A steering device of an outboard motor, the outboard motor housing an engine in an engine case fixed to a stern board of a hull and having a propulsion unit driven by the engine outside of the engine case, a power transmission mechanism including an intermediate speed reducer, and a tilt mechanism including a tilt shaft, the steering device comprising:

a swivel bracket installed in a predetermined part of a rear portion of the engine case, said swivel bracket pivotably supporting the propulsion unit around a steering shaft, wherein said propulsion unit is rotatable to the engine case fixed to the stern board around an axis of the steering shaft, wherein axes of a drive shaft driving the propulsion unit and of the steering shaft are set coaxially to each other, wherein output of the engine is transmitted to the drive shaft of the propulsion unit via an input shaft of the intermediate speed reducer, an axis of the input shaft being provided coaxially with an axis of the tilt shaft of the tilt mechanism, and wherein the drive shaft and the input shaft are connected with each other at an upper end of the drive shaft via bevel gears.

2. The steering device of the outboard motor according to claim 1, wherein the drive shaft is supported in a freely rotatable manner in a swivel vertical direction in said swivel bracket, and wherein a drive shaft housing to house the drive shaft and including the steering axis is rotatably supported by said swivel bracket, and with a lower end of the drive shaft housing the propulsion unit is integrally connected.

3. The steering device of the outboard motor according to claim 2, comprising:

an actuator steering driving near an upper portion of said swivel bracket, wherein a connection extended portion with the propulsion unit is formed by extending a lower portion of the drive shaft housing backward, thereby to pivotally bias the connection extended portion by an action of the actuator.

4. The steering device of the outboard motor according to claim 2, wherein only the propulsion unit and the drive shaft housing are included as movable members around the steering shaft.

* * * * *